US011486623B2

(12) United States Patent
Mitchell

(10) Patent No.: US 11,486,623 B2
(45) Date of Patent: Nov. 1, 2022

(54) ICE MAKING ASSEMBLY FOR RECEIVING INTERCHANGEABLE MOLD ASSEMBLIES

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 229 days.

(21) Appl. No.: 16/846,549

(22) Filed: Apr. 13, 2020

(65) Prior Publication Data

US 2021/0318051 A1 Oct. 14, 2021

(51) Int. Cl.

| | |
|---|---|
| ***F25C 5/06*** | (2006.01) |
| ***F25C 1/24*** | (2018.01) |
| ***F25C 5/20*** | (2018.01) |

(52) U.S. Cl.

CPC ..... *F25C 5/06* (2013.01); *F25C 1/24* (2013.01); *F25C 5/22* (2018.01); *F25C 2400/10* (2013.01)

(58) Field of Classification Search

CPC .... F25C 5/06; F25C 1/243; F25C 5/22; F25C 1/24; F25C 2400/10; F25C 2305/02

See application file for complete search history.

(56) References Cited

U.S. PATENT DOCUMENTS

| | | | | |
|---|---|---|---|---|
| 3,163,018 | A | 12/1964 | Warner | |
| 3,850,008 | A | 11/1974 | Frazier | |
| 4,261,182 | A | 4/1981 | Elliott | |
| 5,056,321 | A | 10/1991 | Patrick | |
| 7,131,280 | B2 | 11/2006 | Voglewede et al. | |
| 8,037,697 | B2 | 10/2011 | LeClear et al. | |
| 8,539,780 | B2 | 9/2013 | Fallon | |
| 2012/0279246 | A1* | 11/2012 | Velazquez | F25C 1/25 62/340 |
| 2016/0258664 | A1* | 9/2016 | Visin | F25C 1/18 |
| 2018/0023873 | A1* | 1/2018 | Boarman | F25C 5/06 62/3.63 |
| 2018/0202699 | A1* | 7/2018 | Migishima | F25C 5/10 |
| 2021/0372686 | A1* | 12/2021 | Lee | F25C 5/04 |

FOREIGN PATENT DOCUMENTS

| | | | |
|---|---|---|---|
| JP | 4257986 | B2 | 4/2009 |
| KR | 100611496 | B1 | 8/2006 |
| KR | 20060107666 | A | 10/2006 |
| WO | WO2014102111 | A1 | 7/2014 |

* cited by examiner

*Primary Examiner* — Elizabeth J Martin
(74) *Attorney, Agent, or Firm* — Dority & Manning, P.A.

(57) ABSTRACT

An ice maker for a refrigerator appliance includes an ice making assembly defining a receiving chamber in fluid communication with an air duct and a mold assembly removably mounted to the ice making assembly. The mold assembly includes a frame configured for receipt within the receiving chamber of the ice making assembly, a heat exchanger mounted to the frame and defining a mold support surface, and a flexible mold positioned on the mold support surface that is supported by the heat exchanger such that the flexible mold is in thermal communication with the heat exchanger and defines a mold cavity configured to receive a liquid. The mold assembly is replaceable with alternate mold assemblies.

19 Claims, 20 Drawing Sheets

ICE MAKING ASSEMBLY FOR RECEIVING INTERCHANGEABLE MOLD ASSEMBLIES

FIELD OF THE INVENTION

The present subject matter relates generally to refrigerator appliances, and more particularly to ice makers for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

However, conventional ice making assemblies are large, inefficient, experience a variety of performance related issues, and only produce one shape or size of ice cube. For example, conventional twist tray icemakers include a partitioned plastic mold that is physically deformed to break the bond formed between ice and the tray. However, these icemakers require additional room to fully rotate and twist the tray. In addition, the ice cubes are frequently fractured during the twisting process. When this occurs, a portion of the cubes may remain in the tray, thus resulting in overfilling during the next fill process. Further, conventional ice making assemblies only offer one style of ice cube.

Accordingly, a refrigerator appliance having an ice maker with improved versatility would be desirable. More particularly, an ice making assembly for a refrigerator appliance that is compact, efficient, reliable, and capable of forming more than one type of ice cube would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice maker for a refrigerator appliance is provided. The ice maker may include an ice making assembly defining a receiving chamber and being in fluid communication with an air duct, and a mold assembly removably mounted to the ice making assembly. The mold assembly may include a frame configured for receipt within the receiving chamber of the ice making assembly, a heat exchanger mounted to the frame and defining a mold support surface, and a flexible mold positioned on the mold support surface and being supported by the heat exchanger. The flexible mold may be in thermal communication with the heat exchanger and may define a cavity configured to receive a liquid.

According to another exemplary embodiment, a refrigerator appliance is provided which may include a cabinet that defines a chilled chamber, a door rotatably mounted to the cabinet and configured to open and close the chilled chamber, an icebox provided in one of the cabinet and the door, and an ice maker provided in the ice making chamber. The ice maker may include an ice making assembly defining a receiving chamber and being in fluid communication with an air duct and a mold assembly insertable into the ice making assembly. The mold assembly may include a frame configured for receipt in the receiving chamber, a heat exchanger mounted to the frame and defining a mold support surface, and a flexible mold positioned on the mold support surface and being supported by the heat exchanger. The flexible mold may be in thermal communication with the heat exchanger and may define a cavity configured to receive a liquid.

According to still another exemplary embodiment, a mold assembly configured to be inserted into an ice maker is provided. The mold assembly may include a frame, a heat exchanger attached to the frame and defining a mold support surface, a flexible mold in thermal communication with the mold support surface, the flexible mold defining a cavity configured to receive a liquid, at least one lifter configured to contact and deform the flexible mold; and a partition attached to the frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
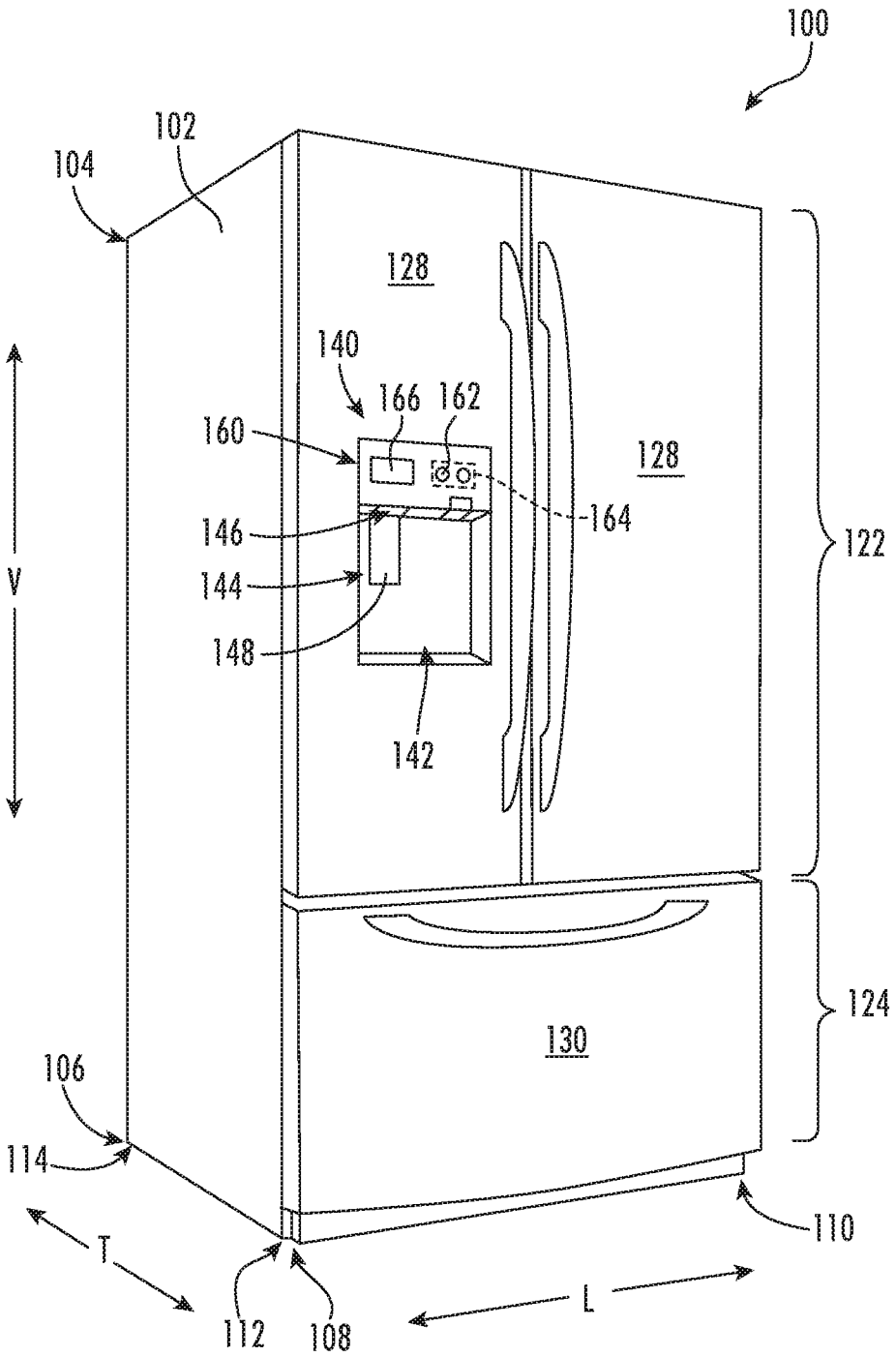
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
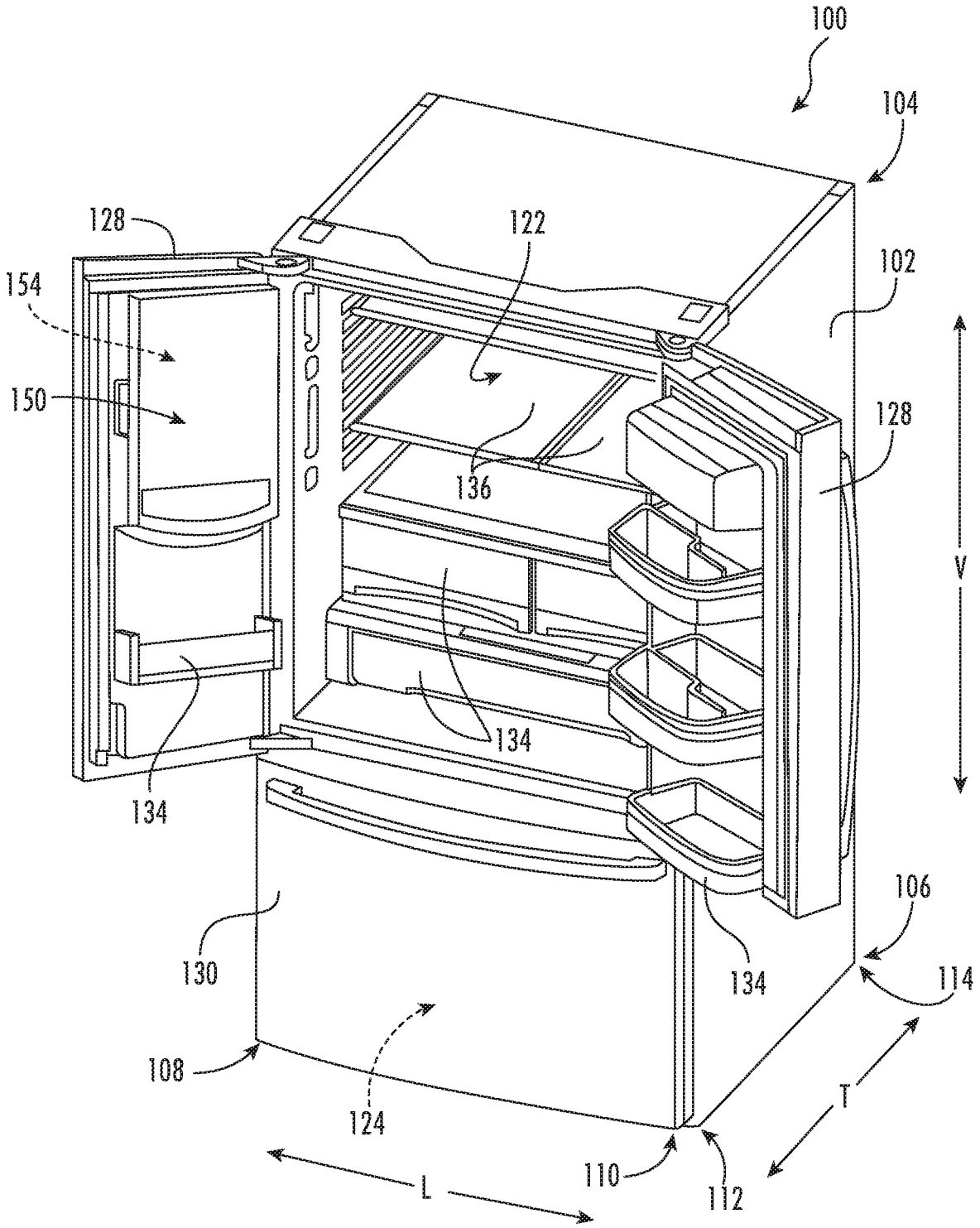
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Figure 3:
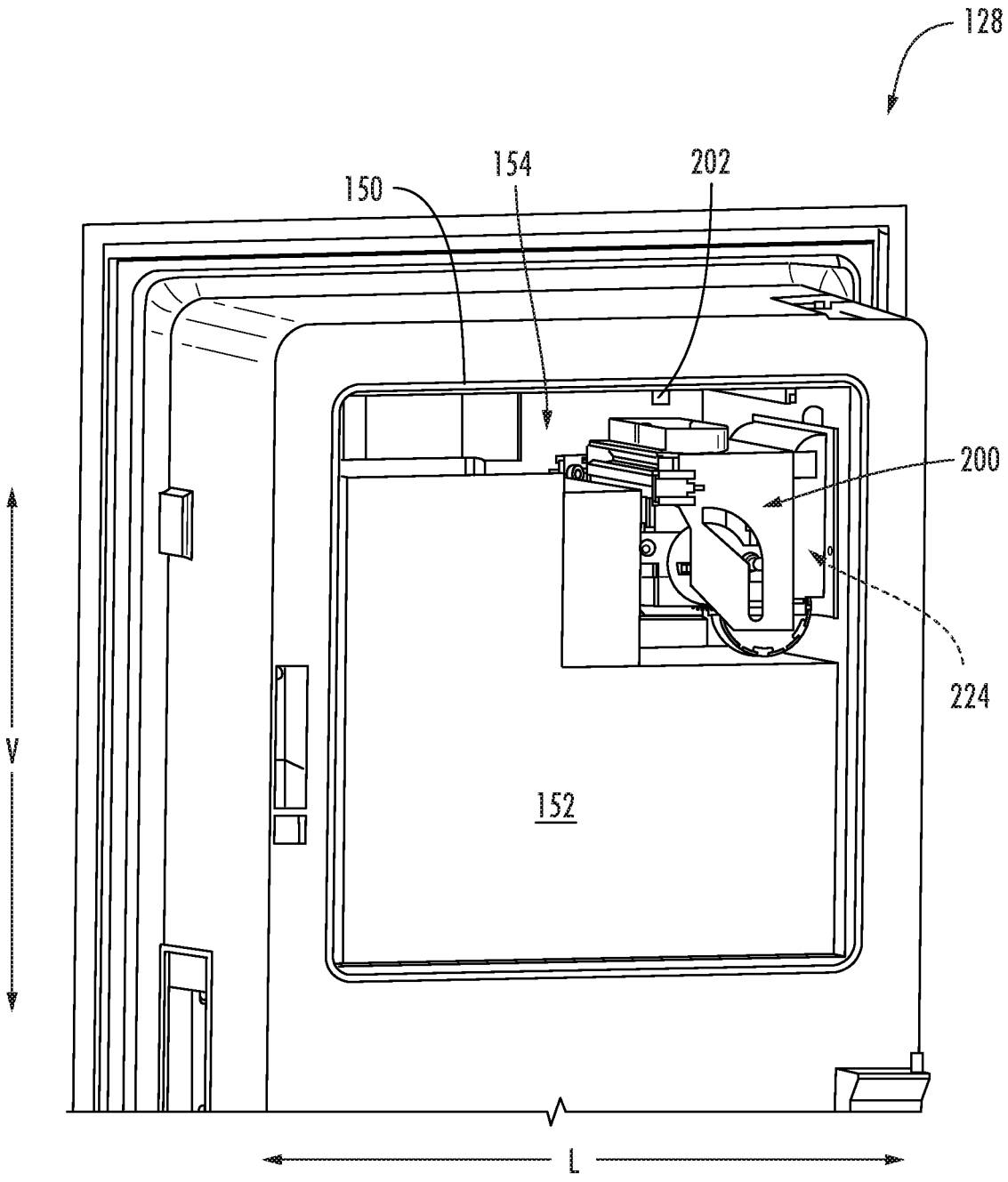
FIG. 3 provides a perspective view of an icebox and ice making assembly for use with the exemplary refrigerator appliance of FIG. 1 according to an exemplary embodiment of the present subject matter.

By contrast, inside refrigerator appliance 100, refrigerator door 128 may define an icebox 150 (FIGS. 2 and 3) housing an icemaker and an ice storage bin 152 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 13, an ice making assembly 200 that may be used with refrigerator appliance 100 will be described according to exemplary embodiments of the present subject matter. As illustrated, ice making assembly 200 is mounted on icebox 150 within ice making chamber 154 and is configured for receiving a flow of water from a water supply spout 202 (see, e.g., FIG. 3). In this manner, ice making assembly 200 is generally configured for freezing the water to form ice cubes 204 which may be stored in storage bin 152 and dispensed through discharging outlet 146 by dispensing assembly 140. However, it should be appreciated that ice making assembly 200 is described herein only for the purpose of explaining aspects of the present subject matter. Variations and modifications may be made to ice making assembly 200 while remaining within the scope of the present subject matter. For example, ice making assembly 200 could instead be positioned within freezer chamber 124 of refrigerator appliance 100 and may have any other suitable configuration.

According to the illustrated embodiment, ice making assembly 200 includes a resilient mold 210 that defines a mold cavity 212. In general, resilient mold 210 is positioned below water supply spout 202 for receiving the gravity-assisted flow of water from water supply spout 202. Resilient mold 210 may be constructed from any suitably resilient material that may be deformed to release ice cubes 204 after formation. For example, according to the illustrated embodiment, resilient mold 210 is formed from silicone or another suitable hydrophobic, food-grade, and resilient material.

According to the illustrated embodiment, resilient mold 210 defines two mold cavities 212, each being shaped and oriented for forming a separate ice cube 204. In this regard, for example, water supply spout 202 is configured for refilling resilient mold 210 to a level above a divider wall (not shown) within resilient mold 210 such that the water overflows into the two mold cavities 212 evenly. According to still other embodiments, water supply spout 202 could have a dedicated discharge nozzle positioned over each mold cavity 212. Furthermore, it should be appreciated that according to alternative embodiments, ice making assembly 200 may be scaled to form any suitable number of ice cubes 204, e.g., by increasing the number of mold cavities 212 defined by resilient mold 210.

Ice making assembly 200 may further include a heat exchanger 220 which is in thermal communication with resilient mold 210 for freezing the water within mold cavities 212 to form one or more ice cubes 204. In general, heat exchanger 220 may be formed from any suitable thermally conductive material and may be positioned in direct contact with resilient mold 210. Specifically, according to the illustrated embodiment, heat exchanger 220 is formed from aluminum and is positioned directly below resilient mold 210. Furthermore, heat exchanger 220 may define a cube recess 222 which is configured to receive resilient mold 210 and shape or define the bottom of ice cubes 204. In this manner, heat exchanger 220 is in direct contact with resilient mold 210 over a large portion of the surface area of ice cubes 204, e.g., to facilitate quick freezing of the water stored within mold cavities 212. For example, heat exchanger 220 may contact resilient mold 210 over greater than approximately half of the surface area of ice cubes 204. It should be appreciated that as used herein, terms of approximation, such as "approximately," "substantially," or "about," refer to being within a ten percent margin of error.

In addition, ice making assembly 200 may comprise an inlet air duct 224 that is positioned adjacent heat exchanger 220 and is fluidly coupled with a cool air supply (e.g., illustrated as a flow of cooling air 226). According to the illustrated embodiment, inlet air duct 224 provides the flow of cooling air 226 from a rear end 228 of ice making assembly 200 (e.g., to the right along the lateral direction L as shown in FIG. 8) through heat exchanger 220 toward a front end 230 of ice making assembly 200 (e.g., to the left along the lateral direction L as shown in FIG. 8, i.e., the side where ice cubes 204 are discharged into storage bin 152).

As shown, inlet air duct 224 generally receives the flow of cooling air 226 from a sealed system of refrigerator appliance 100 and directs it over and/through heat exchanger 220 to cool heat exchanger 220. More specifically, according to the illustrated embodiment, heat exchanger 220 defines a plurality of heat exchange fins 232 that extend substantially parallel to the flow of cooling air 226. In this regard, heat exchange fins 232 extend down from a top of heat exchanger 220 along a plane defined by the vertical direction V in the lateral direction L (e.g., when ice making assembly 200 is installed in refrigerator appliance 100).

Figure 8:
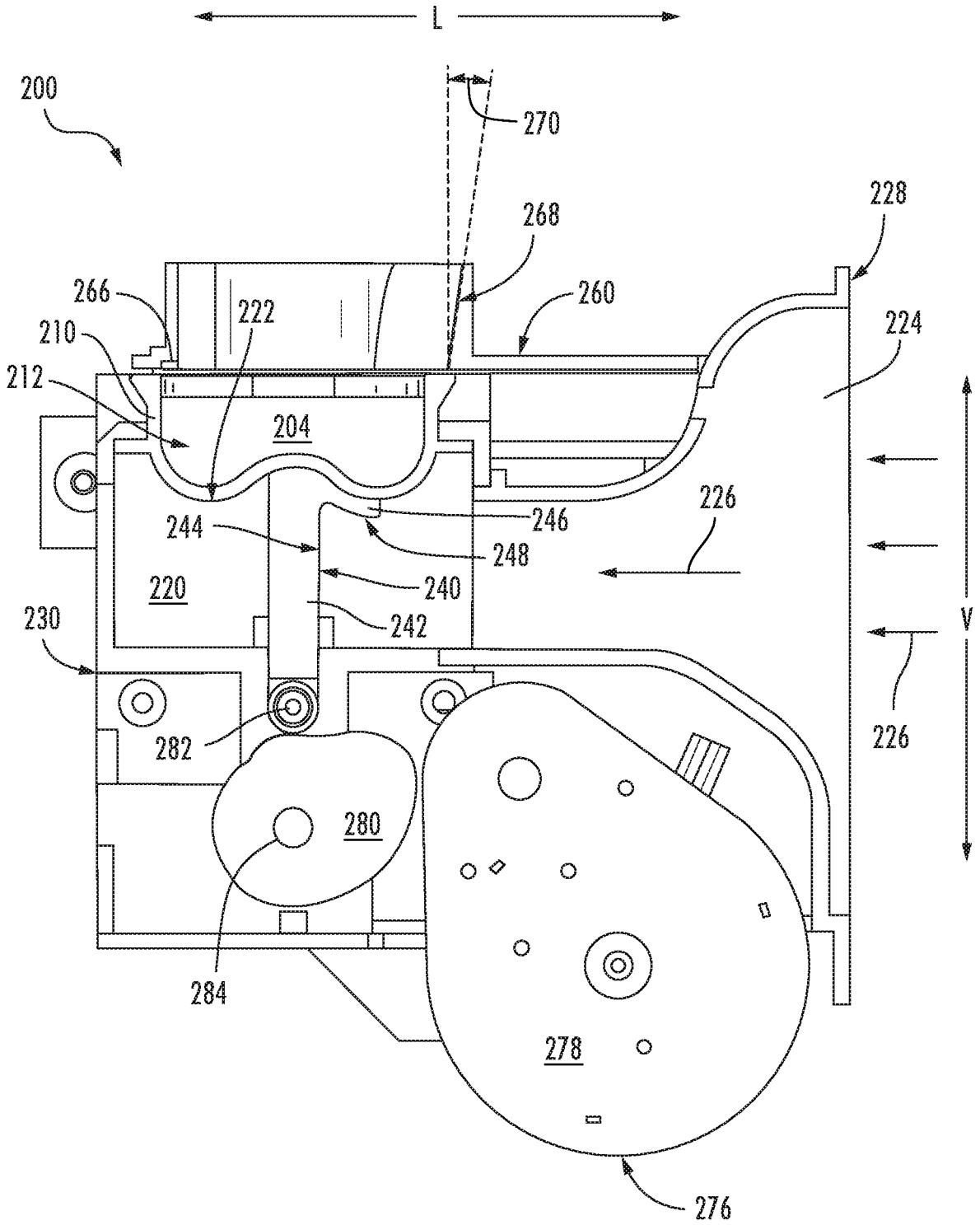
FIG. 8 provides a partial side view of a drive mechanism, a lifter assembly, and a sweep assembly of the exemplary ice making assembly of FIG. 3, with the lifter assembly in a lowered position and the sweep assembly in the retracted position.
Figure 9:
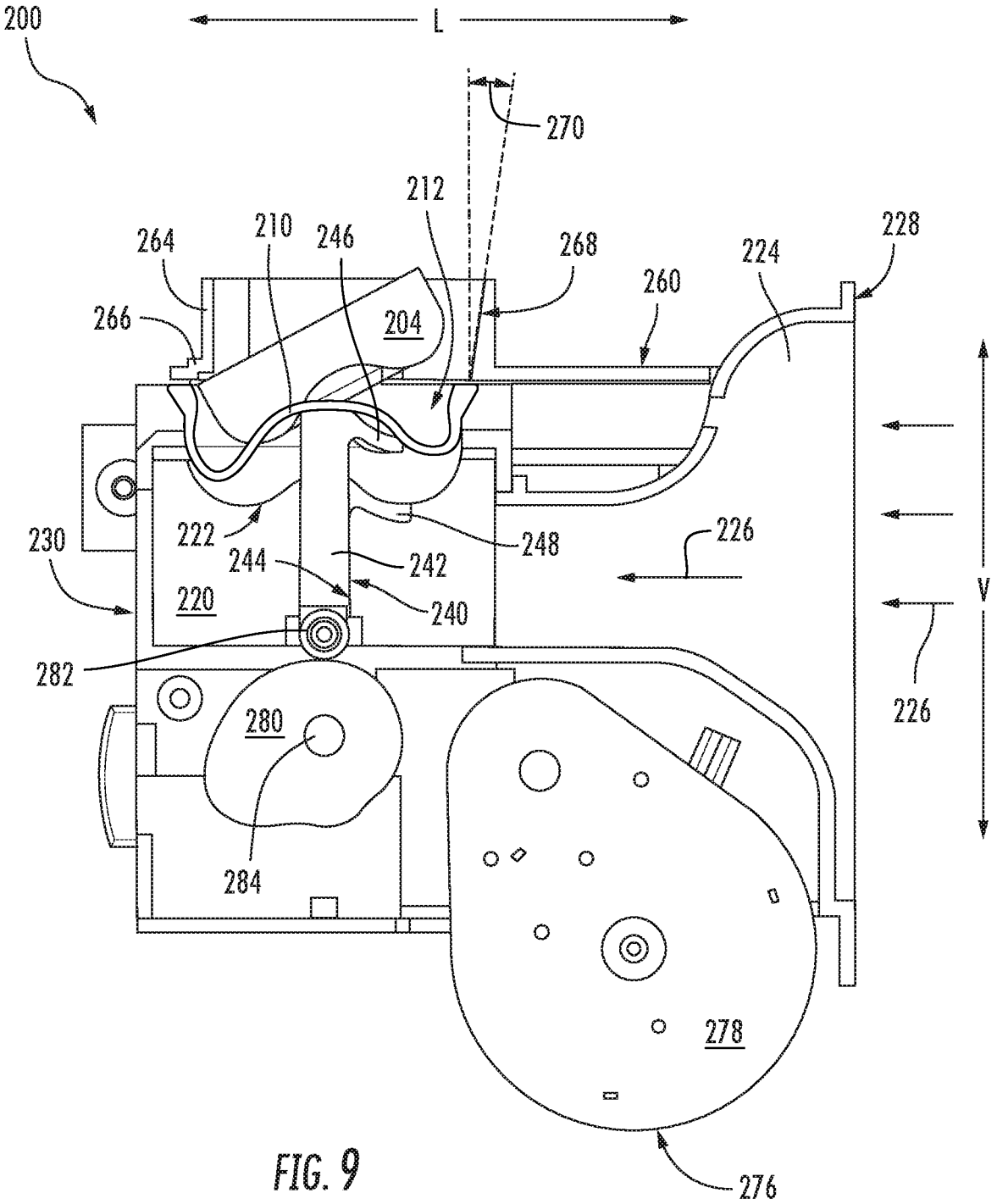
FIG. 9 provides a partial side view of the drive mechanism, the lifter assembly, and the sweep assembly of FIG. 8, with the lifter mechanism in the raised position.

As best shown in FIGS. 8 and 9, ice making assembly 200 further includes a lifter mechanism 240 that is positioned below resilient mold 210 and is generally configured for facilitating the ejection of ice cubes 204 from mold cavities 212. In this regard, lifter mechanism 240 is movable between a lowered position (e.g., as shown in FIG. 8) and a raised position (e.g., as shown in FIG. 9). Specifically, lifter mechanism 240 includes a lifter arm 242 that extends substantially along the vertical direction V and passes through a lifter channel 244 defined within heat exchanger 220. In this manner, lifter channel 244 may guide lifter mechanism 240 as it slides along the vertical direction V.

In addition, lifter mechanism 240 comprises a lifter projection 246 that extends from a top of lifter arm 242 towards a rear end 228 of ice making assembly 200. As illustrated, lifter projection 246 generally defines the profile of the bottom of ice cubes 204 and is positioned flush within a lifter recess 248 defined by heat exchanger 220 when lifter mechanism 240 is in the lowered position. In this manner, heat exchanger 220 and lifter projection 246 define a smooth bottom surface of ice cubes 204. More specifically, according to the illustrated embodiment, lifter projection 246 generally curves down and away from lifter arm 242 to define a smooth divot on a bottom of ice cubes 204.

Figure 6:
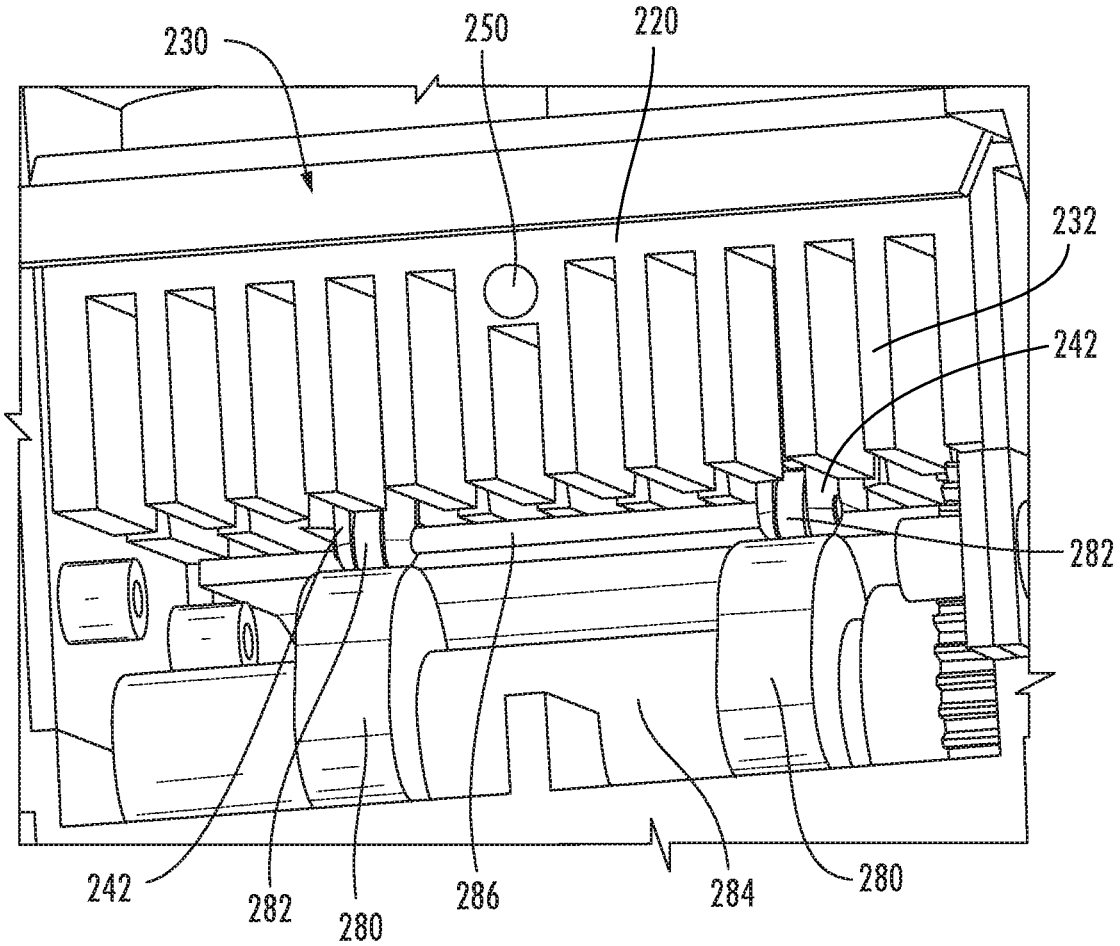
FIG. 6 provides another perspective view of the exemplary ice making assembly of FIG. 3 according to an exemplary embodiment of the present subject matter.

Referring now specifically to FIG. 6, heat exchanger 220 may further define a hole for receiving a temperature sensor 250 which is used to determine when ice cubes 204 have been formed such that an ejection process may be performed. In this regard, for example, temperature sensor 250 may be in operative communication with controller 164 which may monitor the temperature of heat exchanger 220 and the time water has been in mold cavities 212 to predict when ice cubes 204 have been fully frozen. As used herein, "temperature sensor" may refer to any suitable type of temperature sensor. For example, the temperature sensors may be thermocouples, thermistors, or resistance temperature detectors. In addition, although exemplary positioning of a single temperature sensor 250 is illustrated herein, it should be appreciated that ice making assembly 200 may include any other suitable number, type, and position of temperature sensors according to alternative embodiments.

Figure 10:
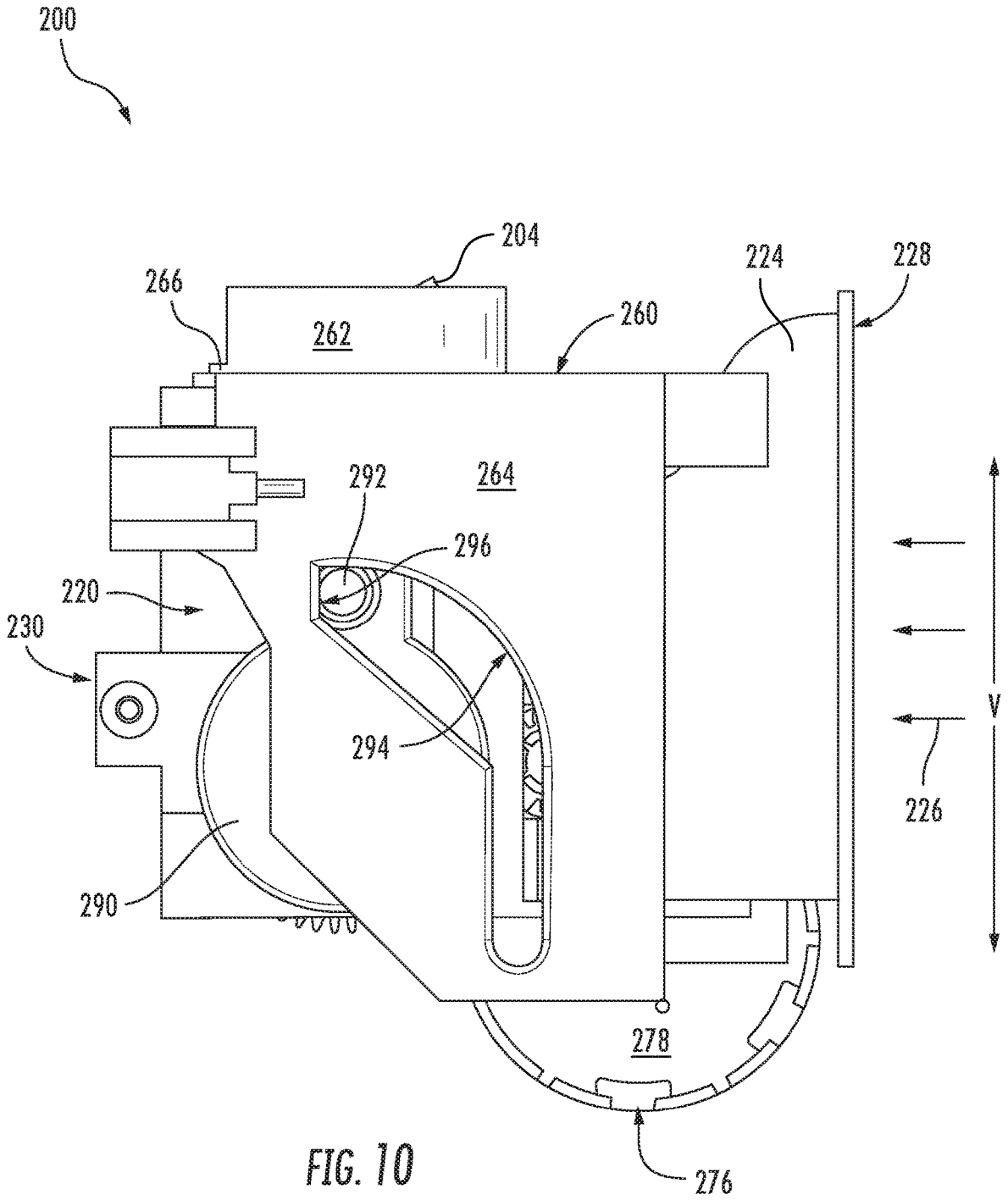
FIG. 10 provides a side view of the drive mechanism, the lifter assembly, and the sweep assembly of FIG. 8.
Figure 11:
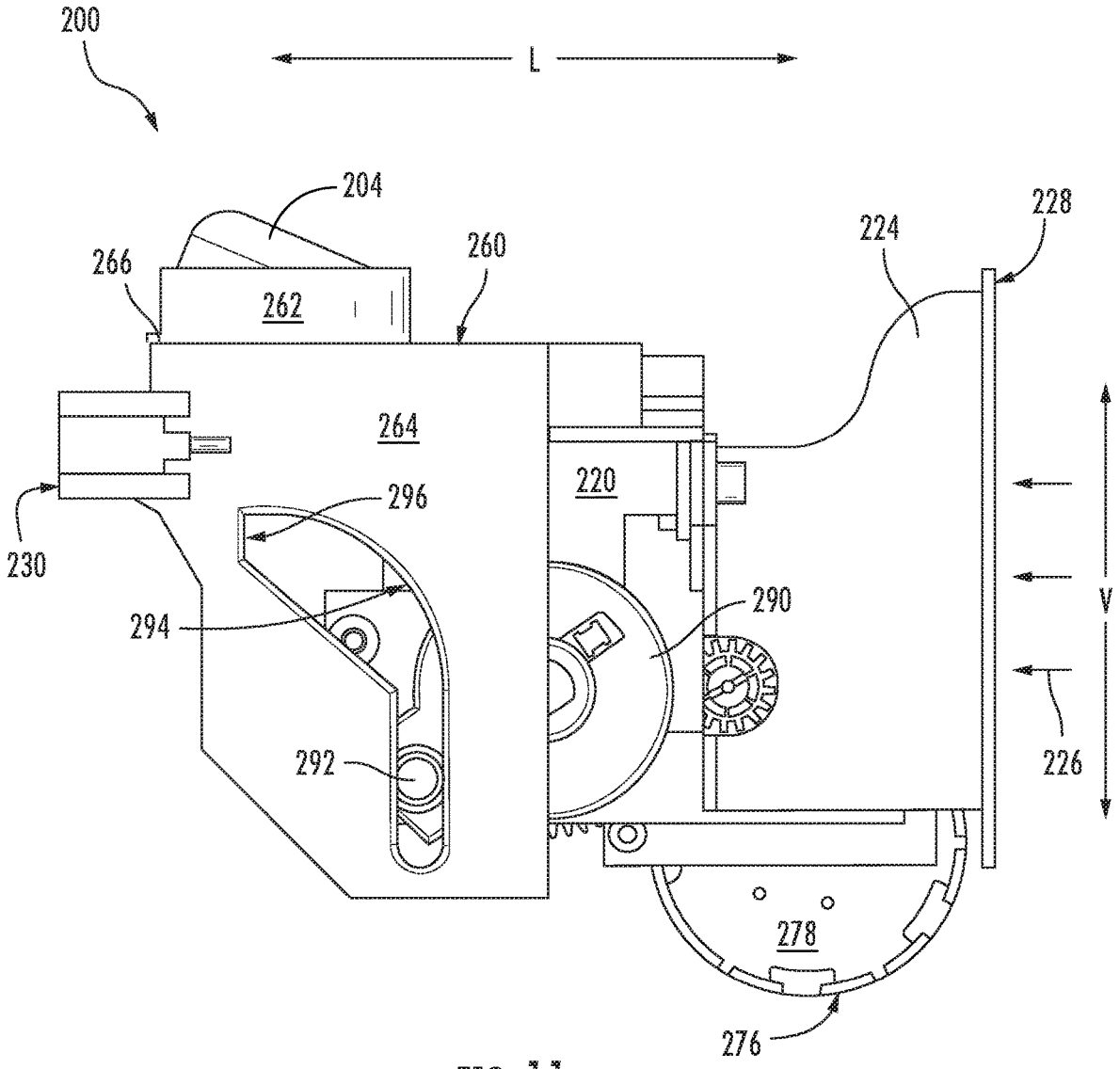
FIG. 11 provides another side view of the drive mechanism, the lifter assembly, and the sweep assembly of FIG. 8, with the sweep assembly in the extended position.
Figure 12:
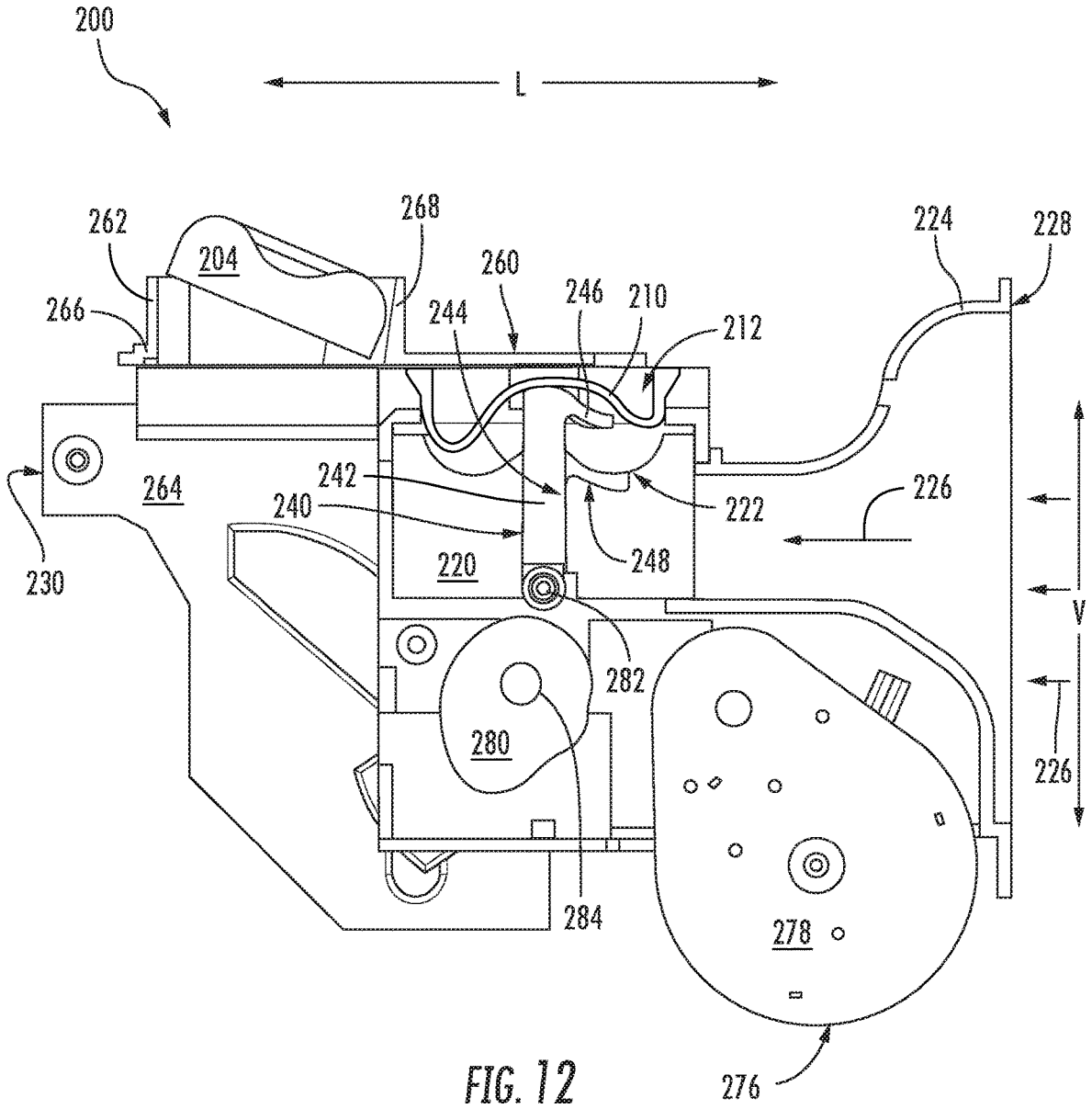
FIG. 12 provides a partial side view of the drive mechanism, the lifter assembly, and the sweep assembly of FIG. 8, with the lifter mechanism in the raised position and the sweep assembly in the extended position.

Referring now specifically to FIGS. 4 and 7-13, ice making assembly 200 further includes a sweep assembly 260 which is positioned over resilient mold 210 is generally configured for pushing ice cubes 204 out of mold cavities 212 and into storage bin 152 after they are formed. Specifically, according to the illustrated embodiment, sweep assembly 260 is movable along the horizontal direction (i.e., as defined by the lateral direction L and the transverse direction T) between a retracted position (e.g., as shown in FIGS. 7 through 10) and an extended position (e.g., as shown in FIGS. 11 and 12).

As described in detail below, sweep assembly 260 remains in the retracted position while water is added to resilient mold 210, throughout the entire freezing process, and as lifter mechanism 240 is moved towards the raised position. After ice cubes 204 are in the raised position, sweep assembly 260 moves horizontally from the retracted to the extended position, i.e., toward front end 230 of ice making assembly 200. In this manner, sweep assembly pushes ice cubes 204 off of lifter mechanism 240, out of resilient mold 210, and over a top of heat exchanger 220 where they may fall into storage bin 152.

Notably, dispensing ice cubes 204 from the top of ice making assembly 200 permits a taller storage bin 152, and thus a larger ice storage capacity relative to ice making machines that dispense ice from a bottom of the icemaker. According to the illustrated embodiment, water supply spout 202 is positioned above resilient mold 210 for providing the flow of water into resilient mold 210. In addition, water supply spout 202 is positioned above sweep assembly 260 such that sweep assembly 260 may move between the retracted position and an extended position without contacting water supply spout 202. According to alternative embodiments, water supply spout 202 may be coupled to mechanical actuator which lowers water supply spout 202 close to resilient mold 210 while sweep assembly 260 is in the retracted position. In this manner, the overall height or profile of ice making assembly 200 may be further reduced, thereby maximizing ice storage capacity and minimizing wasted space.

According to the illustrated embodiment, sweep assembly 260 generally includes vertically extending side arms 262 that are used to drive a raised frame 264 that is positioned over top of resilient mold 210. Specifically, raised frame 264 extends around resilient mold 210 prevents splashing of water within resilient mold 210. This is particularly important when ice making assembly 200 is mounted on refrigerator door 128 because movement of refrigerator door 128 may cause sloshing of water within mold cavities 212.

Raised frame 264 is also designed to facilitate the proper ejection of ice cubes 204. Specifically, according to the illustrated embodiment, sweep assembly 260 defines a forward flange 266 that extends over mold cavities 212 along the vertical direction V proximate front end 230 of ice making assembly 200 when sweep assembly 260 is in the retracted position. In this manner, as lifter mechanism 240 is moved towards the raised position, a front end of ice cubes 204 contacts forward flange 266, such that lifter mechanism 240 (e.g., lifter projection 246) and forward flange 266 cause ice cube 204 to rotate (e.g., counterclockwise as shown in FIG. 9). It should be appreciated that according to alternative embodiments, raised frame 264 may have an open end near front end 230 of ice making assembly 200. In this regard, forward flange 266 may not be needed to facilitate the rotation and/or discharge of ice cubes 204.

In addition, as best shown in FIGS. 8-9 and 12, sweep assembly 260 may further define an angled pushing surface 268 proximate rear end 228 of ice making assembly 200. In general, angled pushing surface 268 is configured for engaging ice cubes 204 while they are pivoted upward and as sweep assembly 260 is moving toward the extended position to further rotate ice cubes 204. Specifically, angled pushing surface may extend at an angle 270 relative to the vertical direction V. According to the illustrated embodiment, angle 270 is less than about 10 degrees, though any other suitable angle for urging ice cubes to rotate 180 degrees may be used according to alternative embodiments.

Referring again generally to FIGS. 4 through 12, ice making assembly 200 may include a drive mechanism 276 which is operably coupled to both lifter mechanism 240 and sweep assembly 260 to selectively raise lifter mechanism 240 and slide sweep assembly 260 to discharge ice cubes 204 during operation. Specifically, according to the illustrated embodiment, drive mechanism 276 comprises a drive motor 278. As used herein, "motor" may refer to any suitable drive motor and/or transmission assembly for rotating a system component. For example, motor 178 may be a brushless DC electric motor, a stepper motor, or any other suitable type or configuration of motor. Alternatively, for example, motor 178 may be an AC motor, an induction motor, a permanent magnet synchronous motor, or any other suitable type of AC motor. In addition, motor 178 may include any suitable transmission assemblies, clutch mechanisms, or other components.

As best illustrated in FIGS. 8 and 9, motor 178 may be mechanically coupled to a rotating cam 280. Lifter mechanism 240, or more specifically lifter arm 242, may ride against rotating cam 280 such that the profile of rotating cam 280 causes lifter mechanism 240 move between the lowered position and the raised position as motor 278 rotates rotating cam 280. In addition, according to an exemplary embodiment, lifter mechanism 240 may include a roller 282 mounted to the lower end of lifter arm 242 for providing a low friction interface between lifter mechanism 240 and rotating cam 280.

Figure 4:
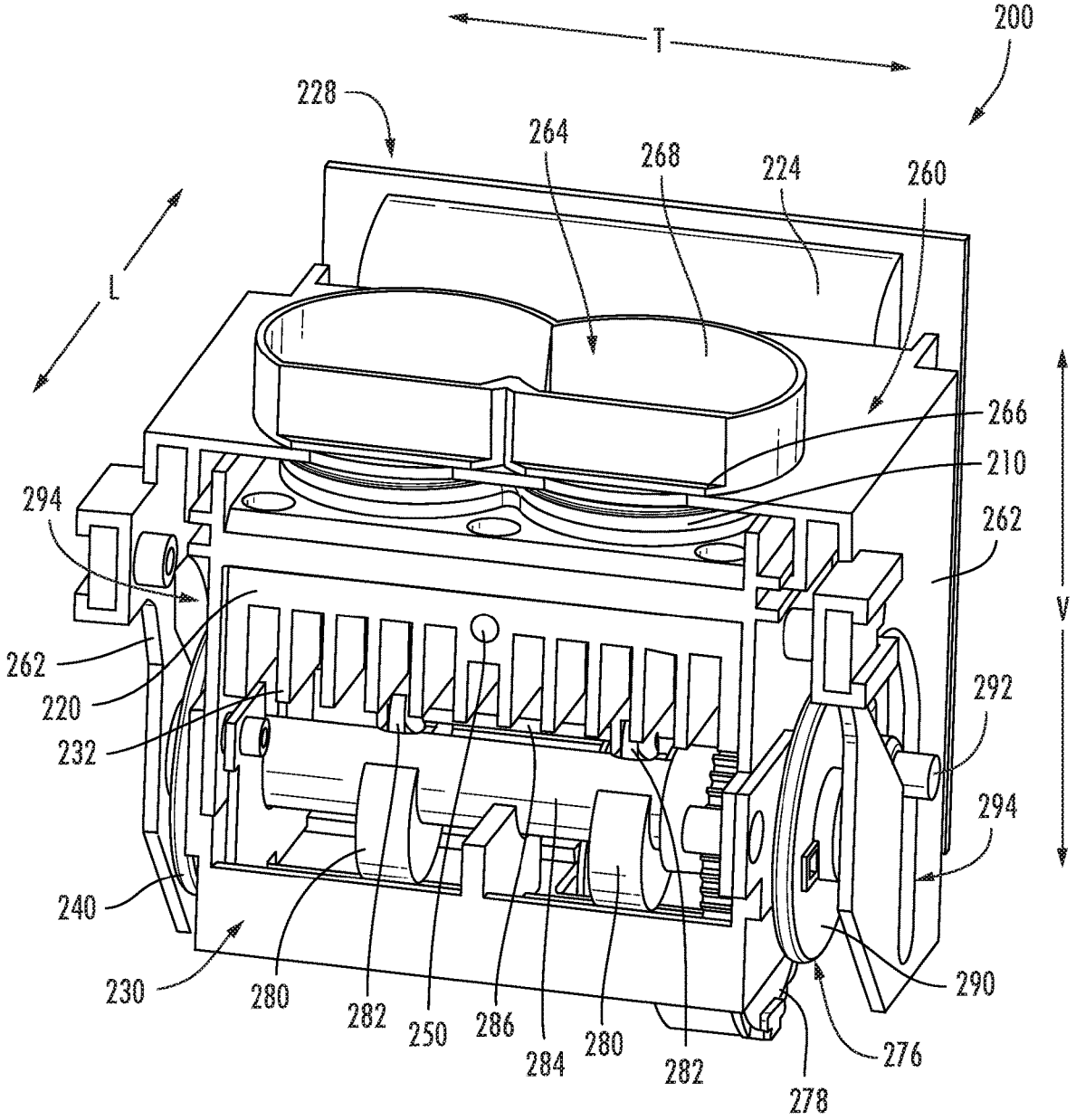
FIG. 4 provides a perspective view of the exemplary ice making assembly of FIG. 3 according to an exemplary embodiment of the present subject matter.
Figure 5:
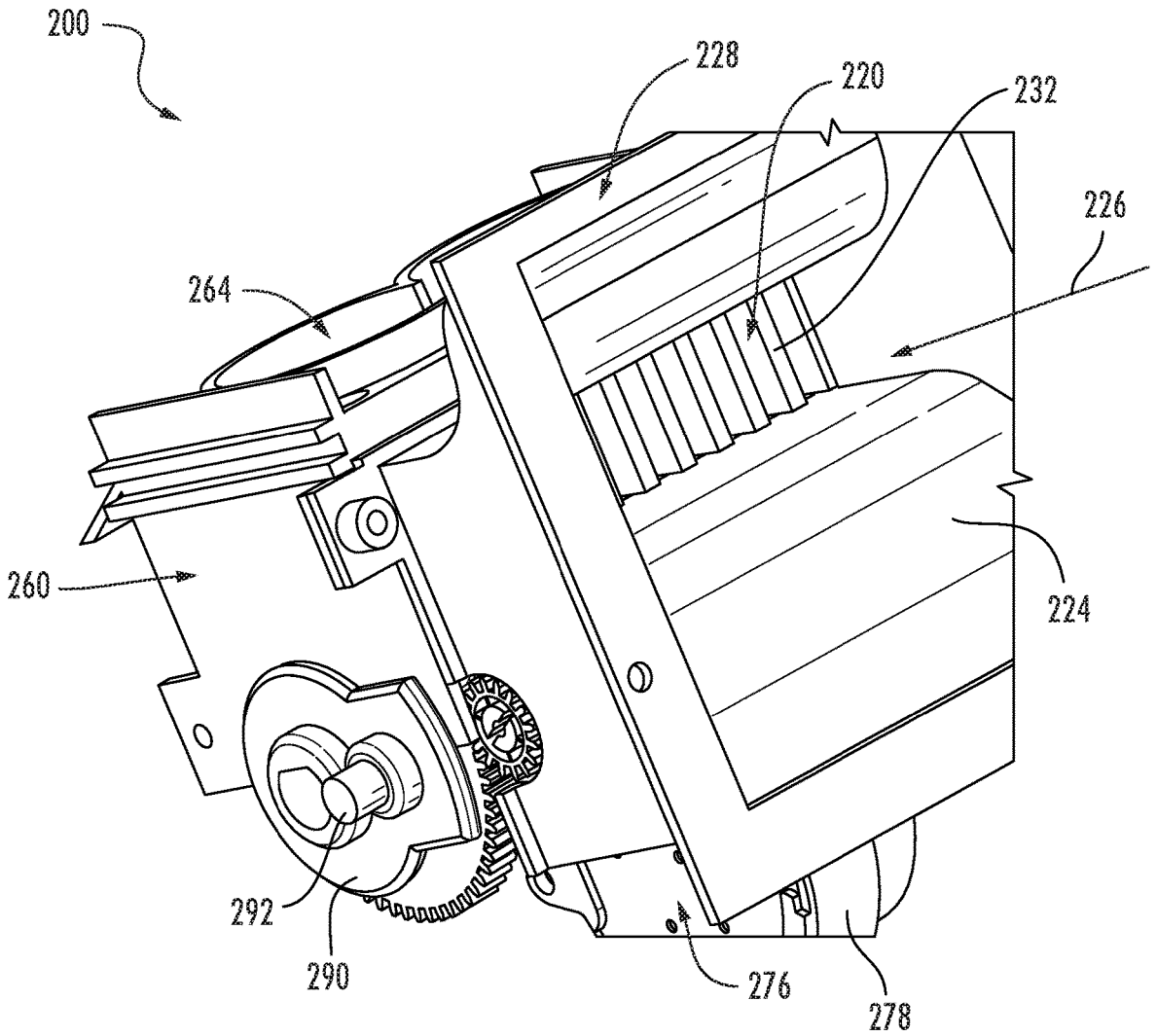
FIG. 5 provides another perspective view of the exemplary ice making assembly of FIG. 3 according to an exemplary embodiment of the present subject matter.

More specifically, as best shown in FIGS. 4 and 6, ice making assembly 200 may include a plurality of lifter mechanisms 240, each of the lifter mechanisms 240 being positioned below one of the ice cubes 204 within resilient mold 210 or being configured to raise a separate portion of resilient mold 210. In such an embodiment, rotating cams 280 are mounted on a cam shaft 284 which is mechanically coupled with motor 278. As motor 278 rotates cam shaft 284, rotating cams 280 may simultaneously move lifter arms 242 along the vertical direction V. In this manner, each of the plurality of rotating cams 280 may be configured for driving a respective one lifter mechanism 240. In addition, as illustrated in FIG. 6, a roller axle 286 may extend between rollers 282 of adjacent lifter mechanisms 240 to maintain a proper distance between adjacent rollers 282 and to keep them engaged on top of rotating cams 280.

Referring still generally to FIGS. 4 through 13, drive mechanism 276 may further include a yoke wheel 290 which is mechanically coupled to motor 278 for driving sweep assembly 260. Specifically, yoke wheel 290 may rotate along with cam shaft 284 and may include a drive pin 292 positioned at a radially outer portion of yoke wheel 290 and extending substantially parallel to an axis of rotation of motor 278 (e.g., an axial direction). In addition, side arms 262 of sweep assembly 260 may define a drive slot 294 which is configured to receive drive pin 292 during operation. Although a single yoke wheel 290 is described and illustrated herein, it should be appreciated that both side arms 262 may include yoke wheel 290 and drive slot 294 mechanisms.

Notably, the geometry of each drive slot 294 is defined such that drive pin 292 moves sweep assembly 260 along the horizontal direction when drive pin 292 reaches an end 296 of drive slot 294. Notably, according to an exemplary embodiment, this occurs when lifter mechanism 240 is in the raised position. In order to provide controller 164 with knowledge of the position of yoke wheel 290 (and drive mechanism 276 more generally), ice making assembly 200 may include a position sensor 298 for determining a zero position of yoke wheel 290.

Figure 13:
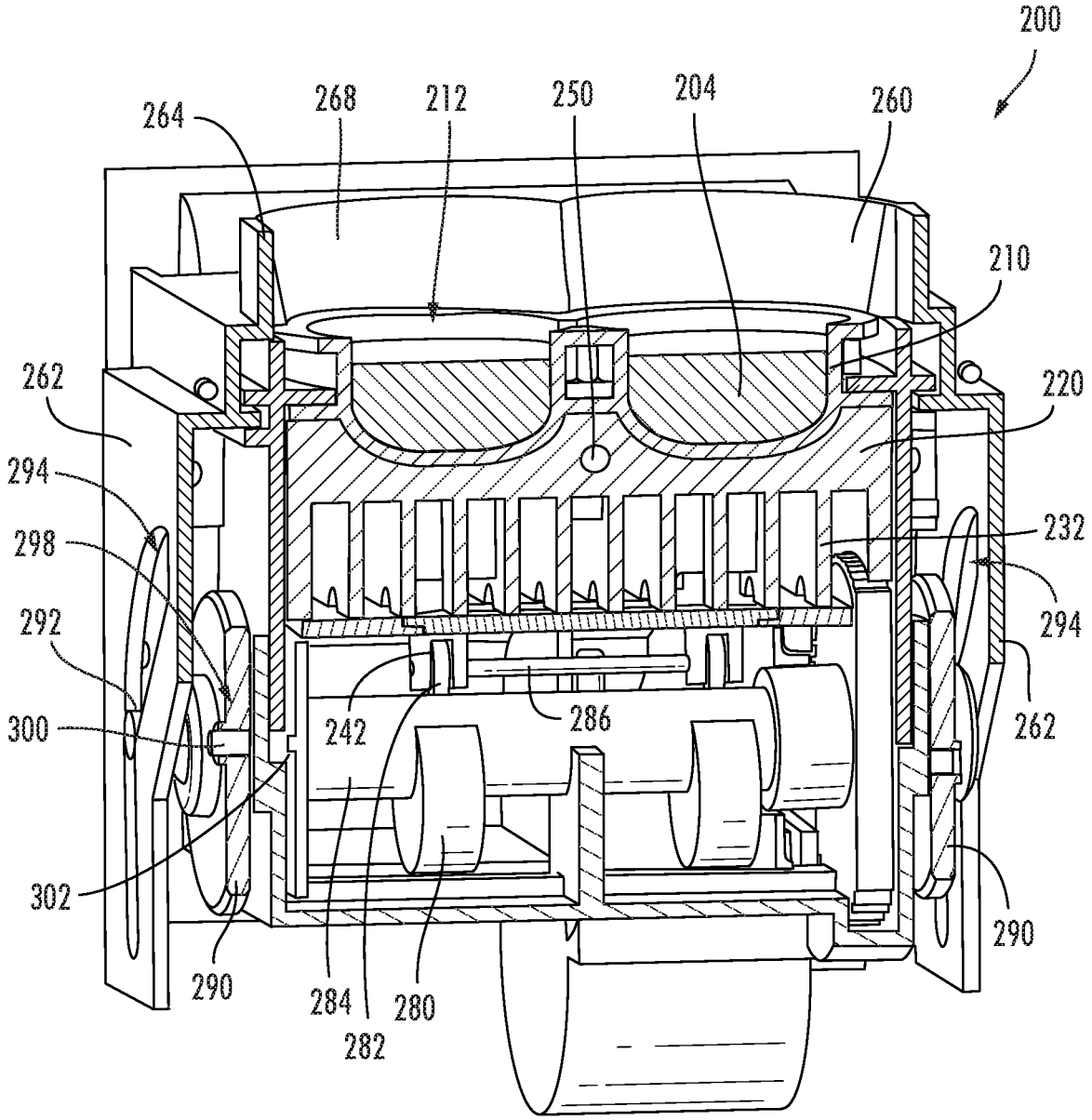
FIG. 13 provides another perspective view of the exemplary ice making assembly of FIG. 3 according to an exemplary embodiment of the present subject matter.

For example, referring briefly to FIG. 13, according to the illustrated embodiment, position sensor 298 includes a magnet 300 positioned on yoke wheel 290 and a hall-effect sensor 302 mounted at a fixed position on ice making assembly 200. As yoke wheel 290 is rotated toward a predetermined position, hall-effect sensor 302 can detect the proximity of magnet 300 and controller 164 may determine that yoke wheel 290 is in the zero position (or some other known position). Alternatively, any other suitable sensors or methods of detecting the position of yoke wheel 290 or drive mechanism 276 may be used. For example, motion sensors, camera systems, optical sensors, acoustic sensors, or simple mechanical contact switches may be used according to alternative embodiments.

According to an exemplary embodiment the present subject matter, motor 278 may begin to rotate after ice cubes 204 are completely frozen and ready for harvest. In this regard, motor 278 rotates rotating cam 280 (and/or cam shaft 284) approximately 90 degrees to move lifter mechanism 240 from the lowered position to the raised position. In this manner, lifter projection 246 pushes resilient mold 210 upward, thereby deforming resilient mold 210 and releasing ice cubes 204. Ice cubes 204 continue to be pushed upward until a front edge of ice cubes 204 contacts forward flange 266 such that lifter projection 246 rotates a rear end of ice cubes 204 upward.

Figure 7:
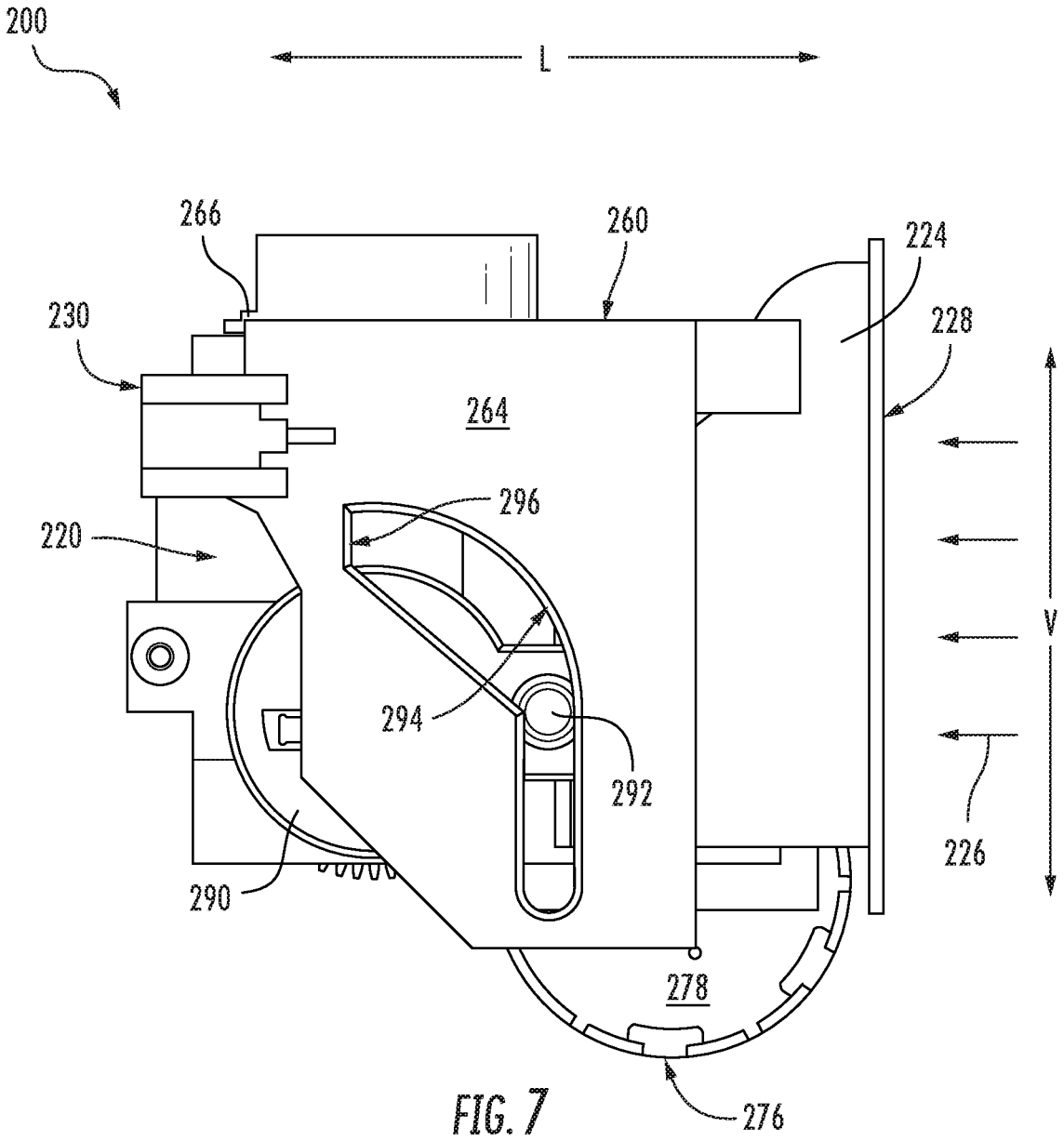
FIG. 7 provides a side view of the exemplary ice making assembly of FIG. 3 according to an exemplary embodiment of the present subject matter.

Notably, as best shown in FIG. 7, yoke wheel 290 rotates with cam shaft 284 such that drive pin 292 rotates within drive slot 294 without moving sweep assembly 260 until yoke wheel 290 reaches the 90° position (e.g., as shown in FIG. 10). Thus, as motor 278 rotates past 90 degrees, lifter mechanism 240 remains in the raised position while sweep assembly 260 moves towards the extended position. In this manner, angled pushing surface 268 engages the raised end of ice cubes 204 to push them out of resilient mold 210 and rotates ice cubes 204 approximately 180 degrees before dropping them into storage bin 152.

When motor 278 reaches 180 degrees rotation, sweep assembly 260 is in the fully extended position and ice cubes 204 will fall into storage bin 152 under the force of gravity. As motor 278 rotates past 180 degrees, drive pin 292 begins to pull sweep assembly 260 back toward the retracted position, e.g., via engagement with drive slot 294. Simultaneously, the profile of rotating cam 280 is configured to begin lowering lifter mechanism 240. When motor 278 is rotated back to the zero position, as indicated for example by position sensor 298, sweep assembly 260 may be fully retracted, lifter mechanism 240 may be fully lowered, and resilient mold 210 may be ready for a supply fresh water. At this time, water supply spout 202 may provide a flow of fresh water into mold cavities 212 and the process may be repeated.

Turning now generally to FIGS. 14 through 22, an alternate embodiment of the ice making assembly 200 will be described. Due to the similarities between embodiments described herein, like reference numerals may be used to refer to the same or similar features. It should also be appreciated that features may be interchangeable between the embodiments described. According to another embodiment, ice making assembly 200 may include a housing 310 that defines a receiving chamber 350 which is in fluid communication with the inlet air duct 224, and a removable mold assembly 400 which is insertable into the receiving chamber 350. The housing 310 may include a first side wall 320 and a second side wall 330 opposite the first side wall 320. The first and second side walls 320, 330 may extend from a front 230 of the ice making assembly 200 toward a rear 228 of the ice making assembly 200 (e.g., in the lateral direction L). A first forward tab 324 may protrude from a front face 322 of the first side wall 320 in a forward direction (e.g., in the lateral direction L). A second forward tab 334 may protrude from a front face 332 of the second side wall 330 in the forward direction (e.g., in the lateral direction L). The first forward tab 324 may be located at about a vertical midpoint of the front face 322 of the first side wall 320. The second forward tab 334 may be located at about a vertical midpoint of the front face 332 of the second side wall 330.

The first and second side walls 320, 330 may be connected to each other by a front wall 340 at a front 230 of the ice making assembly 200 (e.g., opposite the inlet air duct 224). The front wall 340 may extend generally in the vertical direction V and the transverse direction T. The front wall 340 may be located at or near a bottom 312 of the housing 310. The front wall 340 may include one or more guide features or protrusions. For example, according to the illustrated embodiment, a first protrusion 360 and a second protrusion 370 may protrude from a front face 342 of the front wall 340. The first protrusion 360 and the second protrusion 370 may each extend upward (e.g., in the vertical direction V) from a bottom edge 346 of the front wall 340 and may extend to a predetermined distance up the front face 342 of the front wall 340. The first protrusion 360 and the second protrusion 370 may extend an equal distance upward. A top surface 362 of the first protrusion 360 and a top surface 372 of the second protrusion 370 may be provided below a top edge of the front wall 340. Further, the first protrusion 360 and the second protrusion 370 may be spaced apart from each other in the transverse direction T.

The ice making assembly 200 may include one or more retention features for securing the removable mold assembly 400 within the receiving chamber 350. The one or more retention features may be guided by the one or more guide features or protrusions provided on the front wall 340. For example, a latch 380 may be attached to the front wall 340 of the housing 310 and may retain the removable mold assembly 400 within the receiving chamber 350 of the housing 310. The latch 380 may be configured to move in the vertical direction V along the front face 342 of the front wall 340. The latch 380 may be located between the first protrusion 360 and the second protrusion 370, and may be guided in the vertical direction V by the first protrusion 360 and the second protrusion 370. The latch 380 may be biased in the vertical direction V by a spring 384 or elastic member. The spring 384 may be provided below the latch 380. The spring 384 may be attached to a bottom 312 of the housing 310. The spring 384 may be any suitable spring capable of biasing the latch 380 in an upward direction (e.g., the vertical direction V). In one example, the spring 384 is a leaf spring. It should be appreciated that other retention features are possible and within the scope of the present subject matter, e.g., a swivel latch, a mechanical fastener, a magnet, or the like.

Figure 17:
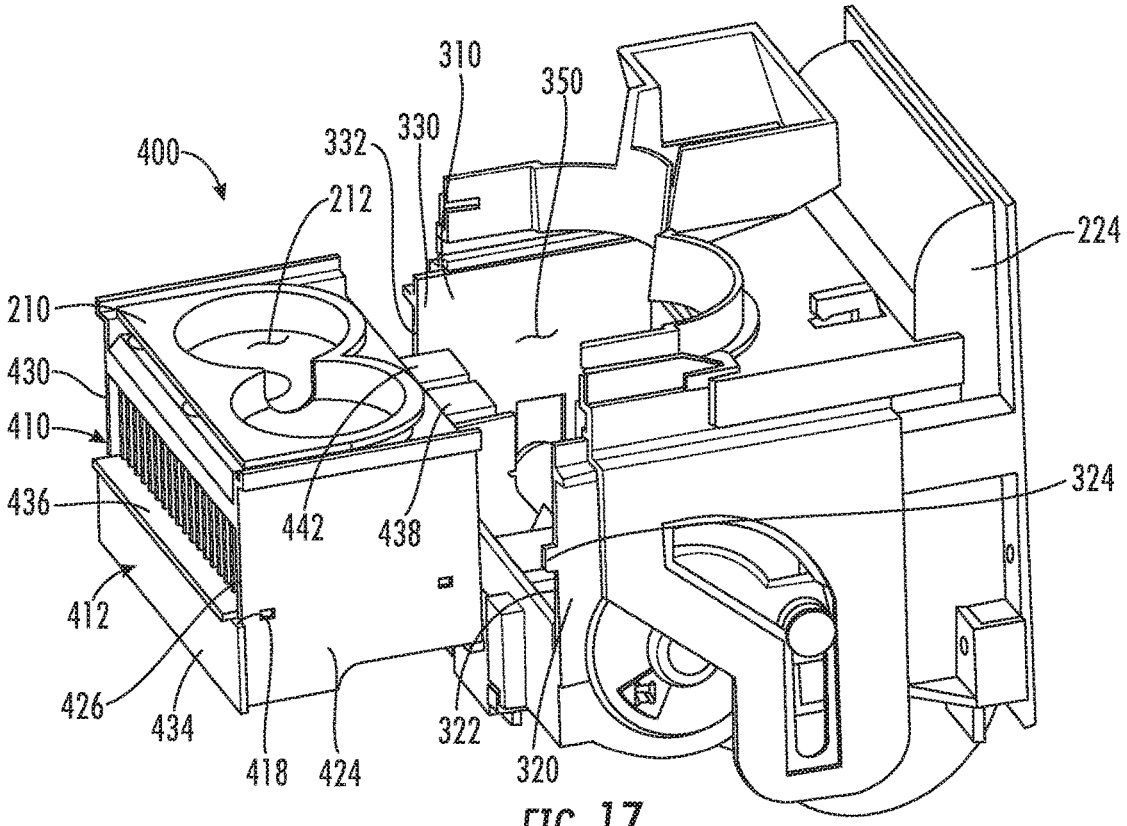
FIG. 17 provides a perspective view of the exemplary ice making assembly of FIG. 14 with the mold assembly removed from the housing.
Figure 18:
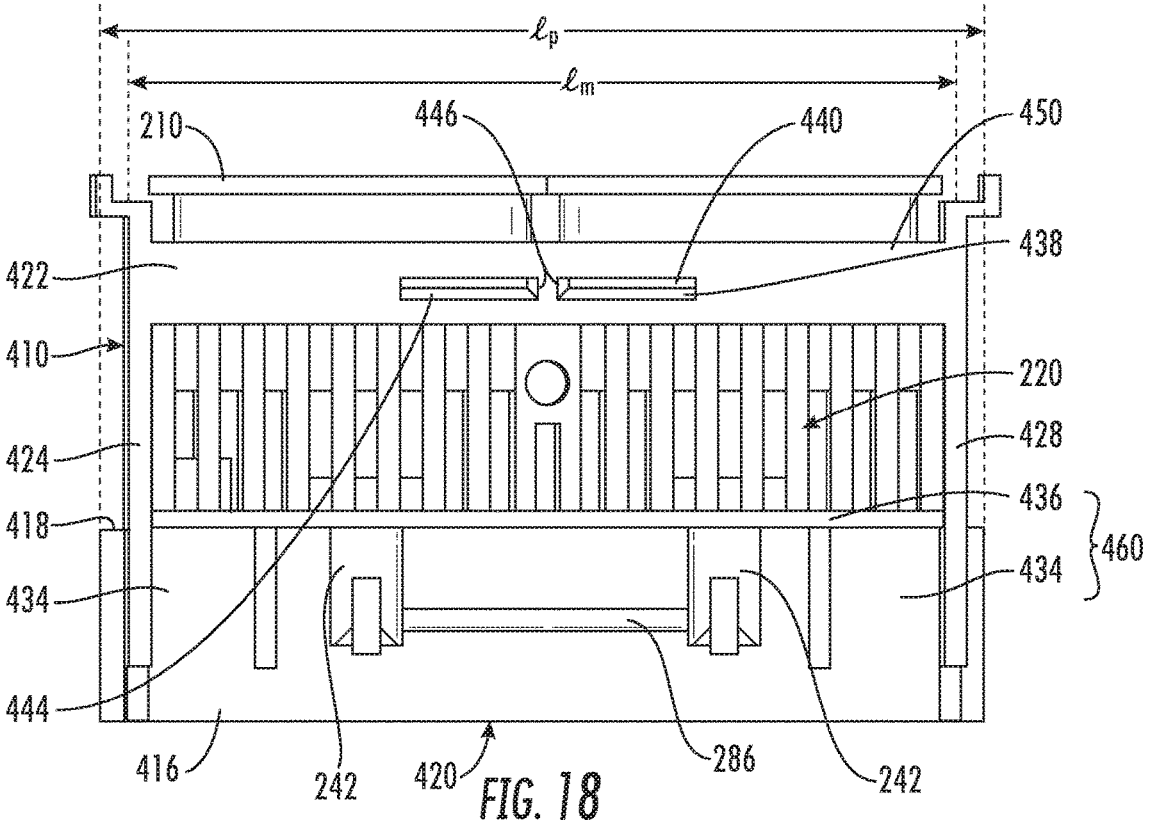
FIG. 18 provides a rear view of the mold assembly of FIG. 14 removed from the housing.
Figure 19:
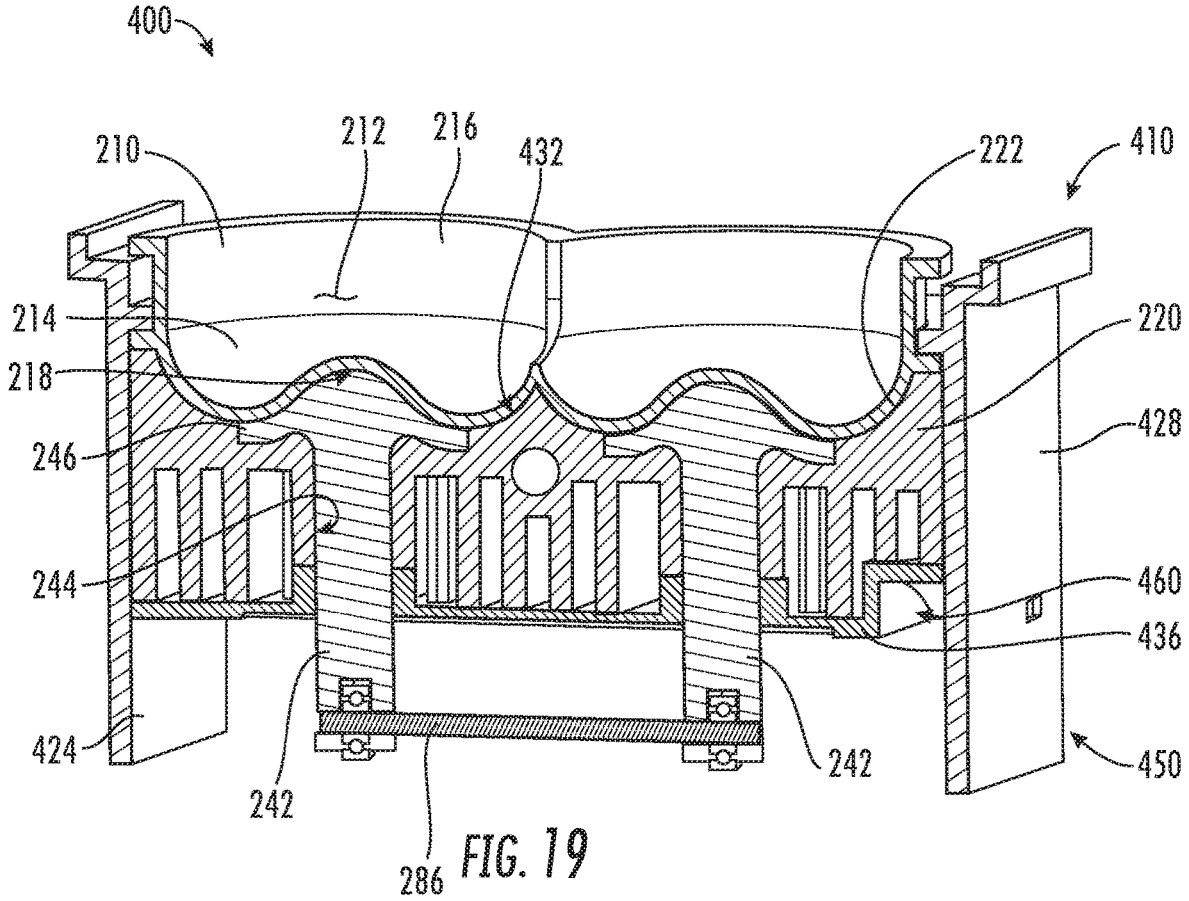
FIG. 19 provides a partial perspective view of the mold assembly of FIG. 14 removed from the housing.

Referring to FIGS. 17 through 19, the removable mold assembly 400 may be generally rectangular in shape. The removable mold assembly 400 may include a frame 410, the heat exchanger 220, the resilient or flexible mold 210, and the lifter mechanism 240 including lifter arm 242, lifter projection 246, and roller axle 286. The frame 410 may include a mold frame 450 and a partition 460. The frame 410 may define a front panel 412, a rear panel 422, a first side panel 424, and a second side panel 428. The mold frame 450 may support the heat exchanger 220. In one example, the heat exchanger 220 is located between the first side panel 424 and the second side panel 428 of the frame 410. The heat exchanger 220 may include a mold support surface 432 in contact with the flexible mold 210. The mold support surface 432 may include cube recess 222. The mold support surface 432 may support the flexible mold 210 and provide a direct contact for heat exchange.

The partition 460 may include a first plate 434 that generally defines a portion of the front panel 412 of the frame 410. The first plate 434 may extend substantially in the vertical direction V and the transverse direction T. A rear face 416 of the front panel 412 may contact a front face 426 of the first side panel 424 and a front face 430 of the second side panel 428 of the frame 410. A length of the first plate 434 in the transverse direction T may be longer than a distance between the first side panel 424 and the second side panel 428 of the frame 410. In other words, a length $l_p$ of the partition 460 in the transverse direction T is longer than a length $l_m$ of the mold frame 450 in the transverse direction T. The partition 460 may further include a second plate 436 that extends substantially in the lateral direction L and the transverse direction T and is perpendicular to the first plate 434. The second plate 436 may extend rearward from a top portion of the first plate 434 (e.g., in the lateral direction L). The heat exchanger 220 may be positioned on top of the second plate 436. As previously described, the heat exchanger 220 may define a plurality of heat exchange fins 232 that extend substantially parallel to the flow of cooling air 226 from the inlet air duct 224.

The rear panel 422 may extend in the transverse direction T and the vertical direction V and may connect the first side panel 424 and the second side panel 428 to each other at a rear of the frame 410. The rear panel 422 may be provided at or near a top of the frame 410 to allow the flow of cooling air 226 to pass through the heat exchange fins 232 of the heat exchanger 220. The rear panel 422 may include an alignment feature for aligning the removable mold assembly 400 within the receiving chamber 350. The alignment feature may be a rear tab 438 that projects rearward (e.g., in the lateral direction L) from the rear panel 422. It should be appreciated that the alignment feature may have any design capable of guiding the removable mold into the receiving chamber 350. According to an exemplary embodiment, the rear tab 438 may be provided at or near a center of the rear panel 422 in the transverse direction T. The rear tab 438 may be provided at or near a center of the rear panel 422 in the vertical direction V. The rear tab 438 may have a slit 446 formed therein at a center thereof. In one embodiment, the slit 446 extends from a rear edge 440 of the rear tab 438 in the lateral direction L toward the rear panel 422. In another embodiment, the rear tab 438 is formed as a pair of rear tabs 438 spaced apart in the transverse direction T to form a gap between the pair of rear tabs 438. In this embodiment, the rear tabs 438 are parallel to each other in the transverse direction T.

With reference to FIG. 19, the flexible mold 210 may include a mold bottom 214 and a mold side 216. At least a portion of the mold bottom 214 may contact the mold support surface 432. For instance, an outer surface of the mold bottom 214 (e.g., with respect to the mold cavity 212) predominantly rests on the mold support surface 432. The mold side 216 may extend in the vertical direction V from the mold bottom 214. In one embodiment, the mold side 216 is cylindrical. In another embodiment, the mold side 216 comprises a plurality of mold sides 216 that form a closed cross-section in the lateral direction L and transverse direction T. In one example, the plurality of mold sides 216 comprises four mold sides 216 forming a square cross-section. As such, the mold bottom 214 and the mold side 216 may form the mold cavity 212. Further, any suitable number of mold sides 216 may be used to form various shapes of the mold cavity 212.

The mold bottom 214 may include a stress relief feature 218. The stress relief feature 218 may be formed at or near a center of the mold bottom 214. In one example, the stress relief feature 218 is an inverted cup formed into the mold bottom 214. In other words, a center portion of the mold bottom 214 may be raised in the vertical direction V with respect to the surrounding portion of the mold bottom 214. The stress relief feature 218 may resemble a dome shape at or near the center of the mold bottom 214. However, it should be appreciated that the stress relief feature 218 may have any suitable shape such that the center portion of the mold bottom 214 is raised in the vertical direction V with respect to the surrounding portion of the mold bottom 214.

In one example, the lifter projection 246 contacts the stress relief feature 218. In other words, a top of the lifter projection 246 resembles a dome shape that is complementary to a shape of the stress relief feature 218. In another embodiment, the top of the lifter projection 246 is planar with respect to the lateral direction L and the transverse direction T. In other words, a plane of the top surface of the lifter projection 246 is perpendicular to the vertical direction V. The stress relief feature may form a gap or pocket between the mold bottom 214 and the top surface of the lifter projection 246 at the center of the stress relief feature 218. In other words, only an outer peripheral ring of the top surface of the lifter projection 246 may be in contact with the mold bottom 214, and the gap or pocket may be provided within the outer peripheral ring. When the lifter arm 242 moves in the vertical direction V to deform the flexible mold 210, the mold bottom 214 may deform in the lateral direction L and the transverse direction T to spread across the top surface of the lifter projection 246 (e.g., the gap or pocket may collapse). Therefore, stress on the flexible mold 210 may be reduced, in turn reducing material fatigue and failure and prolonging a life of flexible mold 210.

The air duct 224 may be provided at a rear of the housing 310 (e.g., in the lateral direction L). The air duct 224 may define a first outlet 470 and a second outlet 472. The first outlet 470 may communicate with the heat exchanger 220 and allow cooling air to pass between the heat exchange fins 232 of heat exchanger 220. The second outlet 472 may be provided above the first outlet 470 in the vertical direction V and may communicate with the flexible mold 210. Cooling air 226 may thus flow from the second outlet 472 over the flexible mold 210 to flash-cool liquid stored in mold cavities 212. The first outlet 470 and the second outlet 472 may be partitioned by a first surface 474. The first surface 474 may include a curved portion 476 and a flat portion 478. The flat portion 478 may extend in the lateral direction L and the transverse direction T. The curved portion 476 may curve upward (e.g., in the vertical direction V) from the flat portion 478 and may have the second outlet 472 formed therein.

The air duct 224 may include a guide feature or features for guiding or securing the removable mold within the receiving chamber 350. The guide feature may be complimentary to the alignment feature provided on the rear panel 422, such that the alignment feature and the guide feature mechanically engage with each other. In an exemplary embodiment, the guide feature is a T-shaped rail 480 extending along a horizontal direction (e.g., in the lateral direction L). The T-shaped rail 480 may be provided at or near a center of the first surface 474 of the air duct 224 in the transverse direction T. A base 482 of the T-shaped rail 480 may protrude in the vertical direction V from the flat portion 478 of the first surface 474. A pair of arms 484 may protrude in the transverse direction T from a top of the base 482. Thus, the rear tab 438 may be accepted between the pair of arms 484 and the flat portion 478 of the first surface 474 when the mold assembly 400 is inserted into the receiving cavity. In another example, the base 482 of the T-shaped rail 480 may be accepted into the gap formed between the pair of rear tabs 438.

Figure 14:
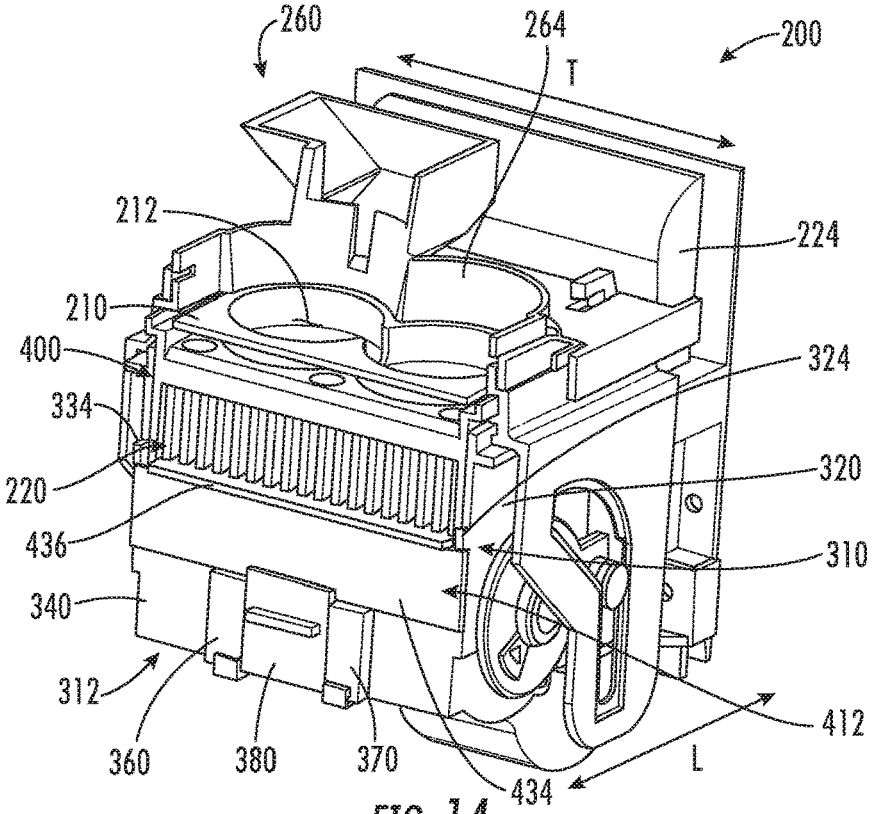
FIG. 14 provides another perspective view of an ice making assembly including a housing and a mold assembly according to an exemplary embodiment.
Figure 15:
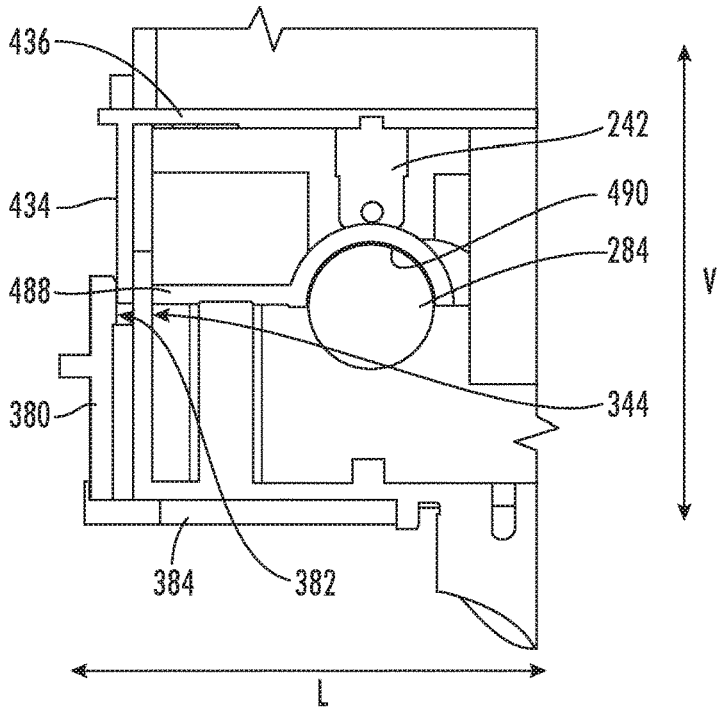
FIG. 15 provides a partial side view of a latch of the housing and the example mold assembly of FIG. 14 in an inserted position.
Figure 16:
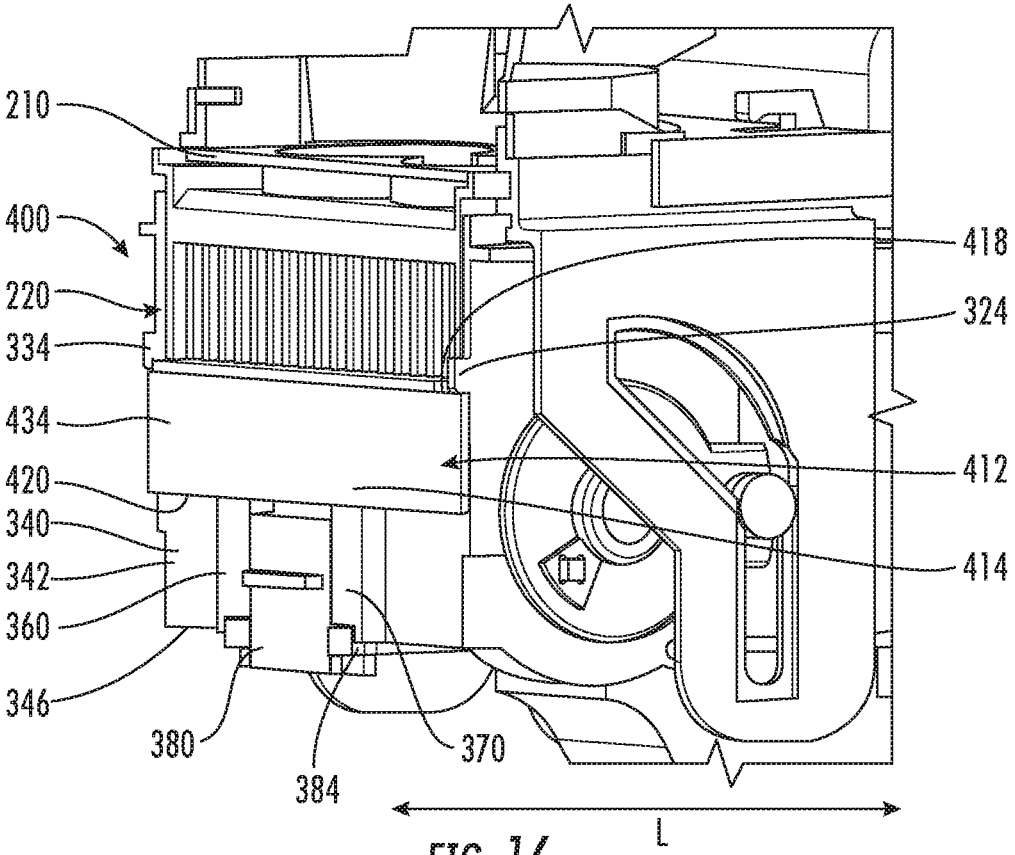
FIG. 16 provides a partial perspective view of the exemplary ice making assembly of FIG. 14, the latch in a retracted position.

Referring to FIGS. 14 through 16, the mold assembly 400 may be removably accommodated within the receiving chamber 350 of the housing 310. In order to insert the mold assembly 400 into the receiving chamber 350, the latch 380 may be displaced downward (e.g., in the vertical direction V). The mold assembly 400 may be fully inserted such that the rear face 416 of the front panel 412 contacts the front face 322 of the first side wall 320 and the front face 332 of the second side wall 330. When the mold assembly 400 is fully inserted into the receiving chamber 350, the latch 380 may be biased upward (e.g., in the vertical direction) until a rear surface 382 of the latch 380 contacts a front face 414 of the front panel 412 of the mold assembly 400. In this manner, the mold assembly 400 is secured within the receiving chamber 350 of the housing 310 to facilitate an ice making operation.

Figure 20:
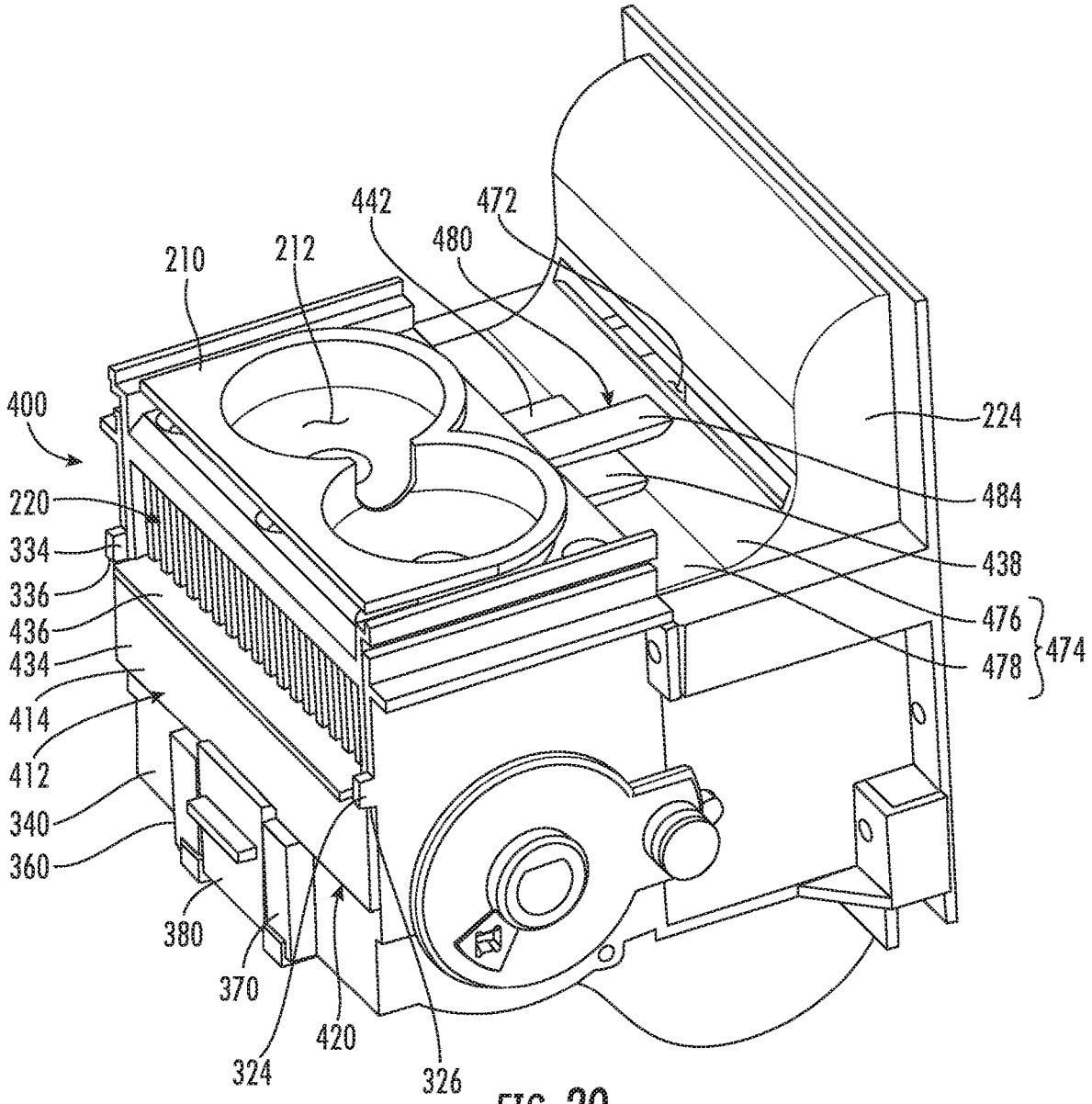
FIG. 20 provides a partial perspective view of the exemplary ice making assembly of FIG. 14 with the sweep assembly removed.
Figure 21:
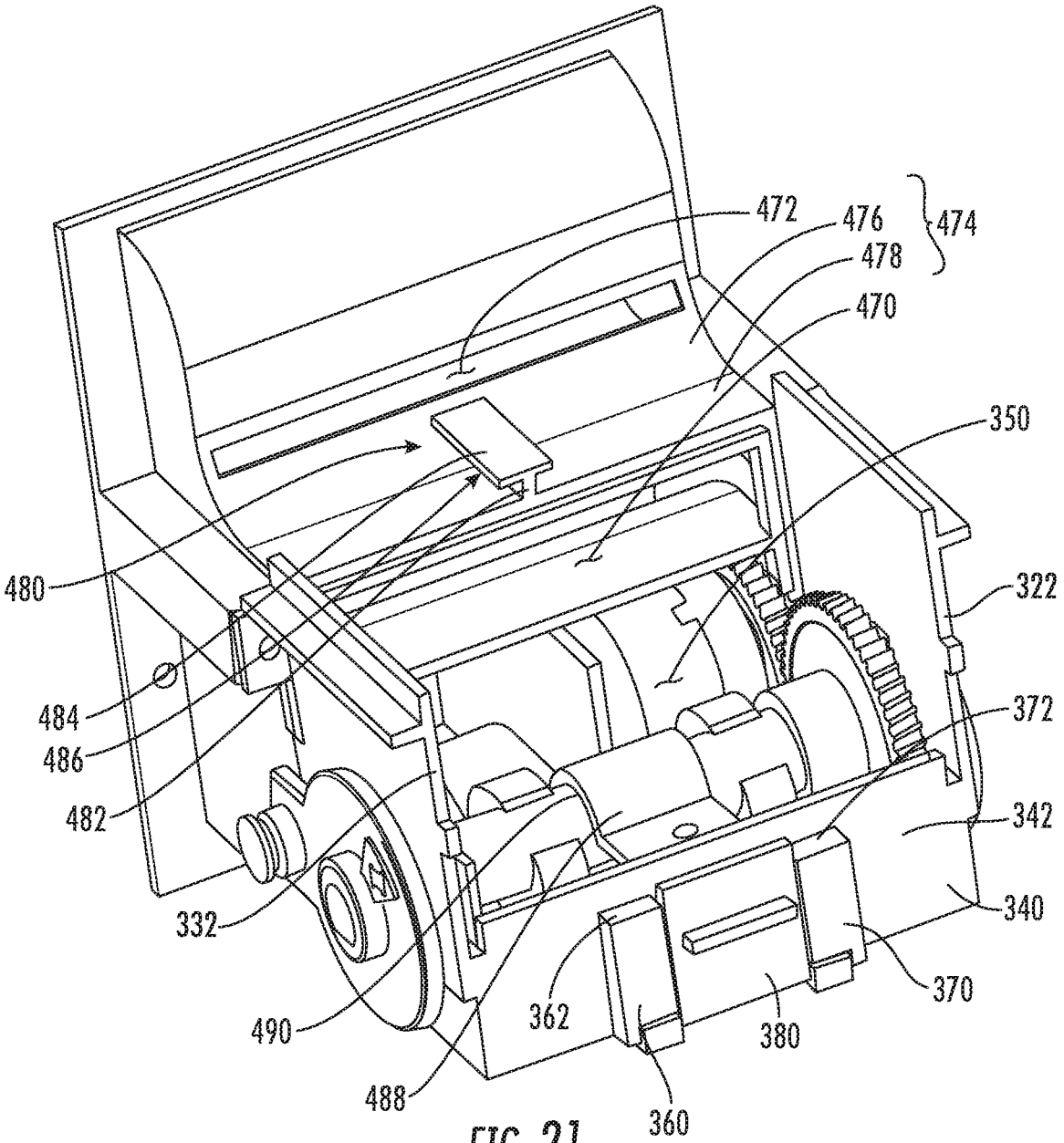
FIG. 21 provides a partial perspective view of the exemplary ice making assembly of FIG. 14 with the sweep assembly and the mold assembly removed.

FIG. 20 illustrates an example of when the mold assembly 400 is fully inserted into the receiving chamber 350. Referring to FIG. 20, a bottom face 420 of the front panel 412 may contact a top surface 362 of the first protrusion 360 and a top surface 372 of the second protrusion 370. A top face 418 of the front panel 412 may contact a bottom surface 326 of the first forward tab 324 and a bottom surface 336 of the second forward tab 334. The rear tab 438 may be interlocked with the T-shaped rail 480. In other words, the base 482 of the T-shaped rail 480 may be inserted into the slit 446 formed in the rear tab 438. An upper surface 442 of the rear tab 438 may contact a lower surface 486 of the pair of arms 484 of the T-shaped rail 480. A bottom surface 444 of the rear tab 438 may contact the flat portion 478 of the first surface 474. Thus, a contact between the rear tab 438 and the T-shaped rail 480 may prevent a movement of the mold assembly 400 in the vertical direction V.

As described earlier, the cam shaft 284 may be provided within the housing 310. A bearing 488 may be attached to the housing 310 and may support the cam shaft 284 within the housing 310. The bearing 488 may be attached to a rear face 344 of the front wall 340 and extend rearward (e.g., in the lateral direction L). The bearing 488 may form an aperture 490 through which the cam shaft 284 passes. The aperture 490 may be opened in the transverse direction T. Thus, the cam shaft 284 may be secured within the housing 310.

Figure 22:
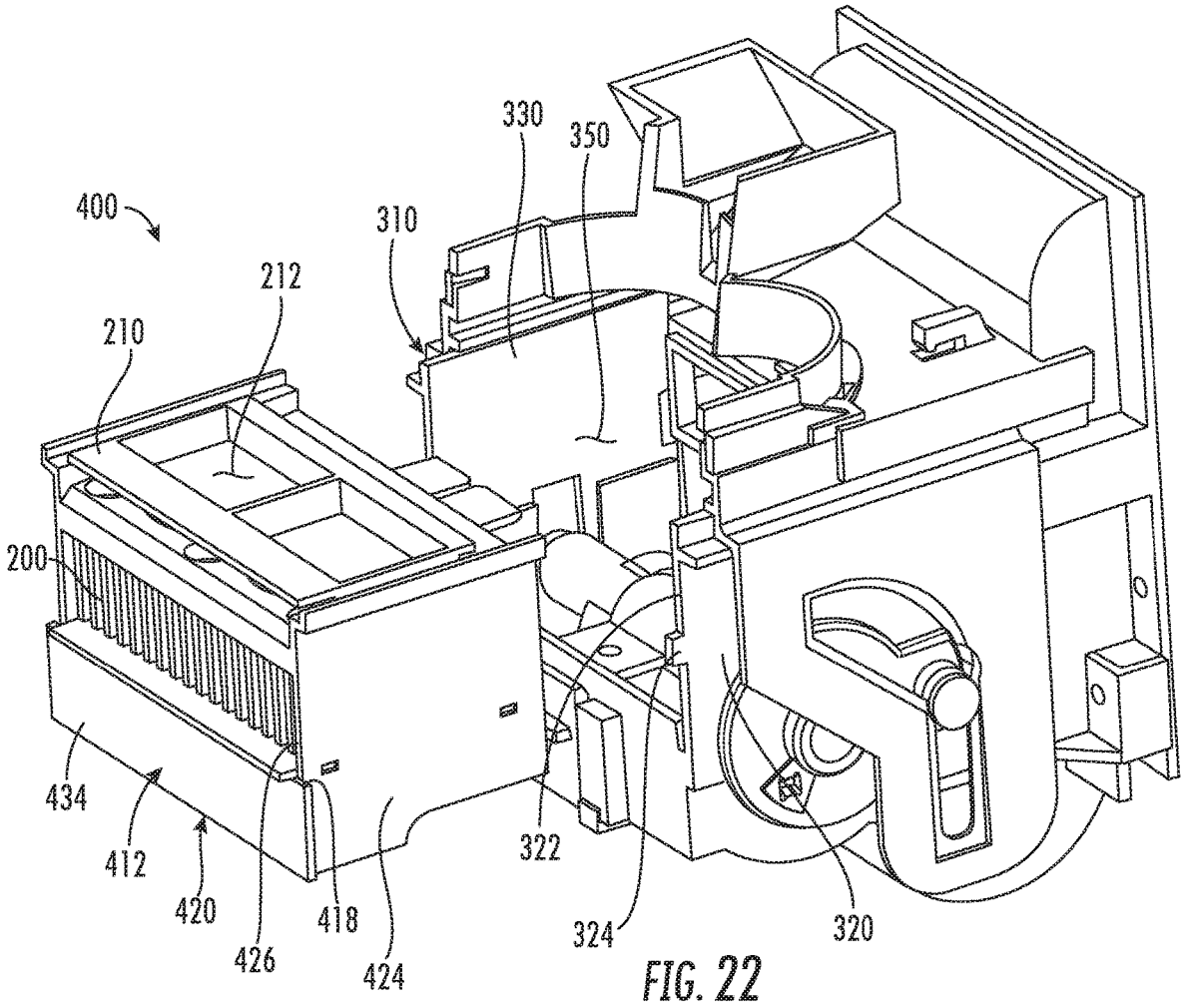
FIG. 22 provides a perspective view of the exemplary ice making assembly of FIG. 14 with an alternate mold assembly in a removed position.

According to one exemplary embodiment, the flexible mold 210 may include one or more mold cavities 212. The one or more mold cavities 212 may be predominantly circular in shape and may have a rounded bottom surface in contact with the mold support surface 432, as seen in FIG. 19. According to another exemplary embodiment, the one or more mold cavities 212 may be predominantly square in shape and may have a flat bottom surface in contact with the mold support surface 432, as seen in FIG. 22. It should be appreciated that any number of molds having any viable three-dimensional shaped mold cavities 212 may be provided. In this manner, a user may remove a first removable mold assembly 400 having a mold cavity 212 with a first shape and insert a second removable mold assembly 400 having a mold cavity 212 with a second shape. Thus, a different shape of ice may be produced according to a desire of the user.

Further, it should be appreciated that the lifter mechanism 240 may be connected to the housing 310 as opposed to the mold assembly 400. For instance, the lifter arm 242, lifter projection 246, and roller axle 286 may be separated from the removable mold assembly 400 and provided within the housing 310. One or more grooves may be formed in the heat exchanger 220 through which the lifter arm 242 passes when the mold assembly 400 is inserted into the receiving chamber 350 of the housing 310.

According to an exemplary embodiment, a removable mold consisting of a flexible rubber mold, heat exchanger, frame, lifter assembly, and partition is removed from the icemaker by depressing a latch. The removable mold is then removed by pulling out on the removable mold. To change the ice shape, a new mold with a different rubber mold cavity 212 shape is inserted into the icemaker. In addition, or alternatively, the heat exchanger may be machined to define a different mold cavity or shape for receiving a flexible rubber mold. The spring pushes the latch back up locking the module into operating position. Retention features on the module prevent it from moving while the icemaker is operational.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker for a refrigerator appliance defining a vertical direction, a lateral direction, and a transverse direction, the ice maker comprising:

an ice making assembly defining a receiving chamber in fluid communication with an air duct; and a mold assembly removably mounted to the ice making assembly, the mold assembly comprising:

a frame configured for receipt within the receiving chamber of the ice making assembly, the frame comprising a rear tab, the rear tab projecting along the lateral direction toward the receiving chamber and extending along the transverse direction;

a heat exchanger mounted to the frame and defining a mold support surface; and a flexible mold positioned on the mold support surface and being supported by the heat exchanger such that the flexible mold is in thermal communication with the heat exchanger and defines a mold cavity configured to receive a liquid.

2. The ice maker of claim 1, wherein the ice making assembly comprises:

a housing forming the receiving chamber;

a latch attached to a front wall of the housing and being configured to retain the mold assembly within the receiving chamber of the housing; and a spring configured to bias the latch in the vertical direction, and wherein a rear surface of the latch contacts a front face of the frame when the mold assembly is inserted into the receiving chamber of the housing.

3. The ice maker of claim 2, wherein the air duct is attached to the housing and includes a T-shaped rail extending along a horizontal direction, and wherein the rear tab defines a slit formed therein for receiving the T-shaped rail.

4. The ice maker of claim 2, wherein the housing comprises a first forward tab that extends forward in the lateral direction from a first side wall of the housing and a second forward tab that extends forward in the lateral direction from a second side wall of the housing, and wherein a bottom surface of each of the first and second forward tabs contacts a top face of the frame when the mold assembly is inserted into the receiving chamber of the housing.

5. The ice maker of claim 4, wherein the frame comprises a mold frame and a partition, wherein a length of the partition in the transverse direction is greater than a length of the mold frame in the transverse direction, and wherein the rear surface of the latch contacts a front face of the partition when the mold assembly is inserted into the receiving chamber of the housing.

6. The ice maker of claim 2, wherein the mold assembly further comprises a plurality of lifters connected by a roller axle and positioned below the flexible mold and the heat exchanger, the plurality of lifters being configured to deform the flexible mold.

7. The ice maker of claim 6, further comprising:

a camshaft provided in the housing;

at least one cam lobe provided on the camshaft and configured to drive the plurality of lifters;

a yoke wheel provided on the camshaft to rotate coaxially with the camshaft and including a pin radially spaced from a rotation axis of the yoke wheel and protruding axially from the yoke wheel;

a motor configured to drive the camshaft; and a bearing attached to the housing and configured to support the camshaft.

8. The ice maker of claim 1, wherein a bottom of the flexible mold is dome shaped.

9. The ice maker of claim 1, wherein the mold assembly is one of a plurality of distinct mold assemblies each having differently shaped three-dimensional mold cavities, wherein each of the plurality of distinct mold assemblies is configured for receipt within the receiving chamber of the ice making assembly.

10. A refrigerator defining a vertical direction, a lateral direction, and a transverse direction, the refrigerator comprising:

a cabinet that defines a chilled chamber;

a door rotatably mounted to the cabinet and configured to open and close the chilled chamber;

an icebox provided in one of the cabinet or the door, the icebox defining an ice making chamber; and an ice maker provided in the ice making chamber, wherein the ice maker comprises:

an ice making assembly defining a receiving chamber in fluid communication with an air duct; and a mold assembly insertable into the ice making assembly, the mold assembly comprising:

a frame configured for receipt in the receiving chamber;

a heat exchanger mounted to the frame and defining a mold support surface;

a flexible mold positioned on the mold support surface and being supported by the heat exchanger such that the flexible mold is in thermal communication with the heat exchanger and defines a mold cavity configured to receive a liquid; and a plurality of lifters connected by a roller axle and positioned below the flexible mold and the heat exchanger, the plurality of lifters being configured to deform the flexible mold.

11. The refrigerator of claim 10, wherein the ice making assembly comprises:

a housing forming the receiving chamber;

a latch attached to a front wall of the housing and being configured to retain the mold assembly within the receiving chamber of the housing; and a spring configured to bias the latch in the vertical direction, and wherein a rear surface of the latch contacts a front face of the frame when the mold assembly is inserted into the receiving chamber of the housing.

12. The refrigerator of claim 11, wherein a bottom of the flexible mold is dome shaped.

13. The refrigerator of claim 11, wherein the air duct is attached to the housing and includes a T-shaped rail, and wherein the frame includes a rear tab defining a slit formed therein for receiving the T-shaped rail.

14. The refrigerator of claim 11, wherein the housing comprises a first forward tab that extends forward in the lateral direction from a first side wall of the housing and a second forward tab that extends forward in the lateral direction from a second side wall of the housing, and wherein a bottom surface of each of the first and second forward tabs contacts a top face of the frame when the mold assembly is inserted into the receiving chamber of the housing.

15. The refrigerator of claim 14, wherein the frame comprises a mold frame and a partition, and wherein a length of the partition in the transverse direction is greater than a length of the mold frame in the transverse direction.

16. The refrigerator of claim 11, further comprising:

a camshaft provided in the housing;

at least one cam lobe provided on the camshaft and configured to drive the plurality of lifters;

a yoke wheel provided on the camshaft to rotate coaxially with the camshaft and including a pin radially spaced from a rotation axis of the yoke wheel and protruding axially from the yoke wheel;

a motor configured to drive the camshaft; and a bearing attached to the housing and configured to support the camshaft.

17. The refrigerator of claim 16, further comprising a sweep assembly movably attached to the ice making assembly, wherein the sweep assembly includes a groove in which the pin is accommodated such that as the camshaft is rotated, the sweep assembly oscillates between a retracted position and an extended position.

18. A mold assembly configured to be inserted into an ice maker, the mold assembly comprising:

a frame;

a heat exchanger attached to the frame and defining a mold support surface;

a flexible mold in thermal communication with the mold support surface, the flexible mold defining a cavity configured to receive a liquid;

at least one lifter configured to contact and deform the flexible mold; and a partition attached to the frame.

19. The mold assembly of claim 18, wherein the at least one lifter comprises a pair of lifters joined by a shaft, and wherein the pair of lifters are provided under the flexible mold and pass vertically through the heat exchanger.

* * * * *